US010945067B2

(12) United States Patent
Sakaguchi

(10) Patent No.: US 10,945,067 B2
(45) Date of Patent: Mar. 9, 2021

(54) AREA REPRODUCTION METHOD, COMPUTER READABLE RECORDING MEDIUM WHICH RECORDS AREA REPRODUCTION PROGRAM, AND AREA REPRODUCTION SYSTEM

(71) Applicant: PANASONIC INTELLECTUAL PROPERTY CORPORATION OF AMERICA, Torrance, CA (US)

(72) Inventor: Atsushi Sakaguchi, Kyoto (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 129 days.

(21) Appl. No.: 16/217,996

(22) Filed: Dec. 12, 2018

(65) Prior Publication Data

US 2019/0208314 A1 Jul. 4, 2019

(30) Foreign Application Priority Data

Dec. 28, 2017 (JP) ..... JP2017-254514

(51) Int. Cl.
*H04R 1/40* (2006.01)
*H04R 3/04* (2006.01)
(Continued)

(52) U.S. Cl.
CPC ..... *H04R 1/403* (2013.01); *H04R 3/04* (2013.01); *H04R 3/12* (2013.01); *H04S 7/302* (2013.01);
(Continued)

(58) Field of Classification Search
CPC .... H04R 1/403; H04R 3/04; H04R 2201/403; H04R 2203/12; H04R 2430/25; H04S 7/302
(Continued)

(56) References Cited

U.S. PATENT DOCUMENTS

2008/0089522 A1* 4/2008 Baba ..... H04S 7/305 381/17
2012/0020480 A1* 1/2012 Visser ..... H04R 3/12 381/17
(Continued)

FOREIGN PATENT DOCUMENTS

JP 2007-135199 A 5/2007
JP 2015-231087 A 12/2015

*Primary Examiner* — Sean H Nguyen
(74) *Attorney, Agent, or Firm* — Greenblum & Bernstein, P.L.C.

(57) ABSTRACT

An area reproduction method includes converting a sound pressure distribution at each frequency of a reproduced sound from a sound pressure distribution in a frequency domain into a sound pressure distribution in a spatial frequency domain. The reproduced sound is realized on a control line, including a reproduction line in which sound waves emitted from a speaker array including a plurality of speakers arranged intensify with each other, and a non-reproduction line in which the sound waves weaken with each other. The method includes determining a spatial frequency for use in adjustment of the reproduced sound, in the sound pressure distribution in the spatial frequency domain, based on a positional relationship between the speaker array and the control line, and adjusting a sound pressure of the reproduced sound, which is to be output by each of the plurality of speakers using the determined spatial frequency.

12 Claims, 26 Drawing Sheets

(51) Int. Cl.
*H04S 7/00* (2006.01)
*H04R 3/12* (2006.01)

(52) U.S. Cl.
CPC .... *H04R 2201/403* (2013.01); *H04R 2203/12* (2013.01); *H04R 2430/25* (2013.01)

(58) Field of Classification Search
USPC ..... 381/182
See application file for complete search history.

(56) References Cited

U.S. PATENT DOCUMENTS

| | | | | |
|---|---|---|---|---|
| 2016/0198282 | A1* | 7/2016 | Kim | H04S 7/301 381/303 |
| 2016/0255454 | A1* | 9/2016 | McGrath | H04S 5/005 381/2 |
| 2018/0279042 | A1* | 9/2018 | Mitsufuji | H04R 3/005 |
| 2019/0014430 | A1* | 1/2019 | Christoph | H04R 5/02 |
| 2019/0208315 | A1* | 7/2019 | Maeno | G10K 11/178 |

* cited by examiner

AREA REPRODUCTION METHOD, COMPUTER READABLE RECORDING MEDIUM WHICH RECORDS AREA REPRODUCTION PROGRAM, AND AREA REPRODUCTION SYSTEM

FIELD OF THE INVENTION

The present disclosure relates to an area reproduction method of outputting a reproduced sound to a predetermined area from a speaker array including a plurality of speakers arranged, a computer readable recording medium which records an area reproduction program, and an area reproduction system.

BACKGROUND ART

There has been conventionally known an area reproduction technique of presenting a sound only to a specific position by using a plurality of speakers or presenting different sounds to separate positions in the same space without interference. Use of this technique enables reproduced sound of different content or sound volume to be presented to each user. For example, Unexamined Japanese Patent Publication No. 2015-231087 and Unexamined Japanese Patent Publication No. 2007-135199 disclose area reproduction techniques based on spatial filtering.

In a conventional area reproduction technique based on spatial filtering, first, an arbitrary control line parallel to a speaker array is set as a reproduction condition, and a reproduction line in which sound waves intensify with each other and a non-reproduction line in which sound waves weaken with each other are set on the control line. Next, a control filter is derived for realizing area reproduction under the set reproduction condition. Ultimately, by allowing each speaker to output a signal obtained by convoluting the derived control filter into a signal of reproduced sound, area reproduction is realized under the set reproduction condition. The control filter and the reproduction condition are correlated with each other by spatial Fourier transformation. It is therefore possible to uniquely derive a control filter from a reproduction condition.

However, in the above-described conventional technique, area reproduction performance backward of a control line provided near a speaker array might be deteriorated to require further improvement.

SUMMARY OF THE INVENTION

An object of the present disclosure, which is intended to solve the above-described problem, is to provide an area reproduction method which enables improvement of deterioration of area reproduction performance backward of a control line provided near a speaker array, a computer readable recording medium which records an area reproduction program, and an area reproduction system.

An area reproduction method according to one aspect of the present disclosure is an area reproduction method of outputting reproduced sound from a speaker array including a plurality of speakers arranged to a predetermined area, in which a sound pressure distribution at each frequency of the reproduced sound is converted from a sound pressure distribution in a frequency domain into a sound pressure distribution in a spatial frequency domain, the reproduced sound being realized on a control line including a reproduction line in which sound waves emitted from the speaker array intensify with each other and a non-reproduction line in which the sound waves weaken with each other, a spatial frequency for use in adjustment of the reproduced sound, in the sound pressure distribution in the spatial frequency domain, is determined based on a positional relationship between the speaker array and the control line, and a sound pressure of the reproduced sound which is to be output by each of the plurality of speakers is adjusted using the determined spatial frequency.

DESCRIPTION OF EMBODIMENTS

Figure 1:
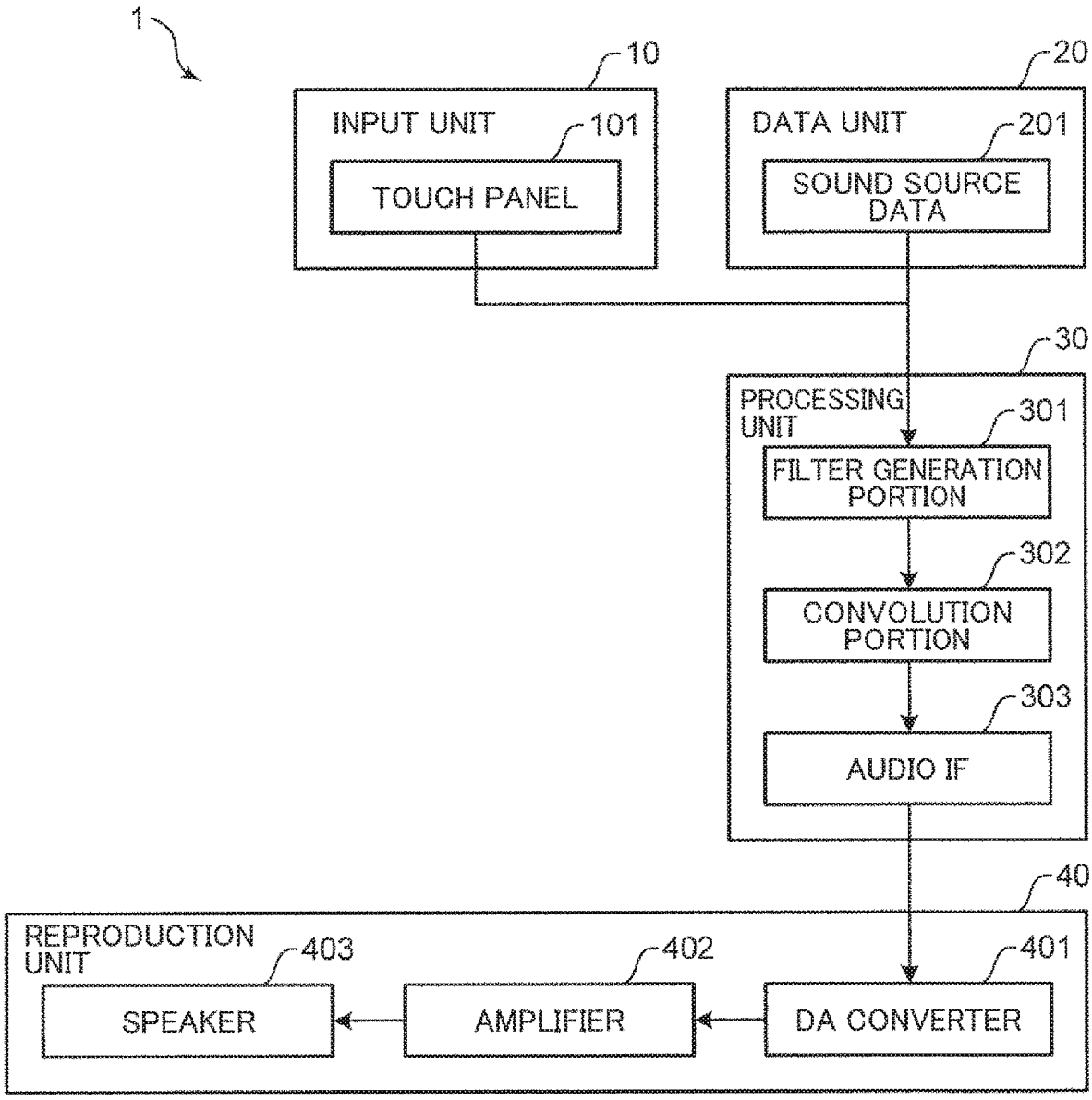
FIG. 1 is a diagram showing a configuration of an area reproduction system in an embodiment of the present disclosure.

Knowledge on Which the Present Disclosure is Based

There has been proposed area reproduction control based on spatial filtering in recent years. Since the reproduction control enables control of reproduced sound not only in a reproduction area to which reproduced sound should be delivered but also in a non-reproduction area to which no reproduced sound should be delivered, higher area reproduction performance can be realized as compared to conventional directivity control.

As described above, in a conventional area reproduction technique based on spatial filtering, first, an arbitrary control line parallel to a speaker array is set as a reproduction condition, and a reproduction line in which sound waves intensify with each other and a non-reproduction line in which sound waves weaken with each other are set on the control line. Next, a control filter is derived for realizing area reproduction under the set reproduction condition. Ultimately, by allowing each speaker to output a signal obtained by convoluting the derived control filter into a signal of reproduced sound, area reproduction is realized under the set reproduction condition. The control filter and the reproduction condition are correlated with each other by spatial Fourier transformation. It is therefore possible to uniquely derive a control filter from a reproduction condition.

Thus, since in the area reproduction control based on spatial filtering, a non-reproduction line can be freely set on a control line as a reproduction condition, reproduced sound can be controlled in a non-reproduction area. In a case of individually reproducing a plurality of different reproduced sounds on the control line, a reproduction condition is set for each reproduced sound, under which reproduction condition, a reproduction place of the reproduced sound is on a reproduction line, and a control filter which realizes area reproduction under each reproduction condition is derived. Then, after convoluting a control filter corresponding to each reproduced sound into a signal of the reproduced sound, the obtained signals are added and output from the respective speakers. This enables a plurality of different reproduced sounds to be individually reproduced on the control line.

In a case where such an area reproduction technique as described above is used in practice, it is demanded to output reproduced sound emitted from a speaker array only onto a reproduction line. However, when the control line is drawn near to the speaker array in order to improve area reproduction performance near the speaker array, while area reproduction performance in the proximity of the control line is improved, area reproduction performance backward of the control line might be deteriorated.

In order to solve the above problem, one aspect of the present disclosure provides an area reproduction method of outputting reproduced sound from a speaker array including a plurality of speakers arranged to a predetermined area, the area reproduction method including: converting a sound pressure distribution at each frequency of the reproduced sound from a sound pressure distribution in a frequency domain into a sound pressure distribution in a spatial frequency domain, the reproduced sound being realized on a control line including a reproduction line in which sound waves emitted from the speaker array intensify with each other and a non-reproduction line in which the sound waves weaken with each other; determining a spatial frequency for use in adjustment of the reproduced sound, in the sound pressure distribution in the spatial frequency domain, based on a positional relationship between the speaker array and the control line; and adjusting a sound pressure of the reproduced sound which is to be output by each of the plurality of speakers using the determined spatial frequency.

According to the configuration, a sound pressure distribution at each frequency of the reproduced sound is converted from a sound pressure distribution in a frequency domain into that in a spatial frequency domain, the reproduced sound being realized on the control line including the reproduction line in which sound waves emitted from the speaker array intensify with each other and the non-reproduction line in which the sound waves weaken with each other. A spatial frequency for use in adjustment of the reproduced sound, in the sound pressure distribution in the spatial frequency domain, is determined based on a positional relationship between the speaker array and the control line. A sound pressure of the reproduced sound which is to be output by each of the plurality of speakers is adjusted using the determined spatial frequency.

Accordingly, since a spatial frequency for use in adjustment of the reproduced sound, in a sound pressure distribution in the spatial frequency domain, is determined based on a positional relationship between the speaker array and the control line, and a sound pressure of the reproduced sound which is to be output by each of the plurality of speakers is adjusted using the determined spatial frequency, limiting a spatial frequency results in decreasing a sound pressure of a non-reproduction area, thereby improving deterioration of area reproduction performance backward of the control line provided near the speaker array.

Additionally, in the above-described area reproduction method, for the determination of the spatial frequency, a spatial frequency for use in the adjustment of the reproduced sound can be determined based on a first angle formed by a plane wave represented by the spatial frequency and an array line along the speaker array and a second angle represented by a straight line linking one point on the array line and one point on the control line and the array line.

According to the configuration, in the determination of the spatial frequency, a spatial frequency for use in the adjustment of the reproduced sound is determined based on the first angle formed by a plane wave represented by the spatial frequency and an array line along the speaker array and the second angle represented by a straight line linking one point on the array line and one point on the control line and the array line.

Accordingly, a spatial frequency for use in the adjustment of reproduced sound can be determined with ease based on the first angle formed by a plane wave represented by the spatial frequency and an array line along the speaker array and the second angle represented by a straight line linking one point on the array line and one point on the control line and the array line.

In the above-described area reproduction method, the spatial frequency kx is represented by Formula (1) below:

$$kx=2\pi n/(N\Delta x) \quad (1)$$

In the above-described Formula (1), N represents the number of the plurality of speakers, n represents an integer and a relation of $-N2 \leq n \leq N/2-1$ is satisfied, Δx represents an interval between speakers adjacent to each other among the plurality of speakers, and the first angle θ is represented by Formula (2) below:

$$\theta=180/\pi a \sin(kx/(\omega/c)) \quad (2)$$

In the above-described Formula (2), ω may represent an angular frequency and c may represent sound velocity.

According to the configuration, since the spatial frequency kx is represented by the above Formula (1) and the first angle θ is represented by the above Formula (2), a spatial frequency for use in the adjustment of reproduced sound can be determined with ease using the first angle θ.

Also in the above-described area reproduction method, the second angle includes a third angle formed by a straight line linking the center of the array line and one end portion of the reproduction line and the array line, and in determination of the spatial frequency, in a case where the first angle θ is smaller than the third angle, the spatial frequency kx corresponding to the first angle θ can be determined as a spatial frequency for use in adjustment of the reproduced sound, and in adjustment of the sound pressure of the reproduced sound, a value of a sound pressure Pkx(θ) of the determined spatial frequency kx can be set to be zero.

According to the configuration, in determination of the spatial frequency, in a case where the first angle θ is smaller than the third angle formed by a straight line linking the center of the array line and one end portion of the reproduction line and the array line, the spatial frequency kx corresponding to the first angle θ is determined as a spatial frequency for use in the adjustment of reproduced sound. Then, in adjustment of the sound pressure of the reproduced sound, a value of the sound pressure Pkx(θ) of the determined spatial frequency kx is set to be zero.

Accordingly, in a case where the first angle θ is smaller than the third angle formed by a straight line linking the center of the array line and one end portion of the reproduction line and the array line, a value of the sound pressure Pkx(θ) of the spatial frequency kx corresponding to the first angle θ becomes zero, so that no side lobe is present in a sound pressure distribution in a spatial frequency domain, and therefore, deterioration of area reproduction performance backward of the control line can be improved and auditory easiness of hearing a reproduced sound can be improved.

Also in the above-described area reproduction method, the second angle includes a fourth angle formed by a straight line linking the center of the array line and one end portion of the control line and the array line, and in determination of the spatial frequency, in a case where the first angle θ is smaller than the fourth angle, the spatial frequency kx corresponding to the first angle θ can be determined as a spatial frequency for use in adjustment of the reproduced sound, and in adjustment of the sound pressure of the reproduced sound, a value of the sound pressure Pkx(θ) of the determined spatial frequency kx can be set to be zero.

According to the configuration, in determination of the spatial frequency, in a case where the first angle θ is smaller than the fourth angle formed by a straight line linking the center of the array line and one end portion of the control line and the array line, the spatial frequency kx corresponding to the first angle θ is determined as a spatial frequency for use in adjustment of the reproduced sound. Then, in adjustment of the sound pressure of the reproduced sound, a value of the sound pressure Pkx(θ) of the determined spatial frequency kx is set to be zero.

Accordingly, in a case where the first angle θ is smaller than the fourth angle formed by a straight line linking the center of the array line and one end portion of the control line and the array line, a value of the sound pressure Pkx(θ) of the spatial frequency kx corresponding to the first angle θ becomes zero, so that no side lobe is present in a sound pressure distribution in a spatial frequency domain, and therefore, deterioration of area reproduction performance backward of the control line can be improved and auditory easiness of hearing a reproduced sound can be improved.

Also in the above-described area reproduction method, the second angle includes a fifth angle formed by a straight line linking one end portion of the array line and the other end portion of the reproduction line and the array line, and in determination of the spatial frequency, in a case where the first angle θ is smaller than the fifth angle, the spatial frequency kx corresponding to the first angle θ can be determined as a spatial frequency for use in adjustment of the reproduced sound, and in adjustment of the sound pressure of the reproduced sound, a value of the sound pressure Pkx(θ) of the determined spatial frequency kx can be set to be zero.

According to the configuration, in determination of the spatial frequency, in a case where the first angle θ is smaller than the fifth angle formed by a straight line linking one end portion of the array line and the other end of the reproduction line and the array line, the spatial frequency kx corresponding to the first angle θ is determined as a spatial frequency for use in adjustment of the reproduced sound. Then, in adjustment of the sound pressure of the reproduced sound, a value of the sound pressure Pkx(θ) of the determined spatial frequency kx is set to be zero.

Accordingly, in a case where the first angle θ is smaller than the fifth angle formed by a straight line linking the one end portion of the array line and the other end of the reproduction line and the array line, a value of the sound pressure Pkx(θ) of the spatial frequency kx corresponding to the first angle θ becomes zero, so that no side lobe is present in a sound pressure distribution in a spatial frequency domain, and therefore, deterioration of area reproduction performance backward of the control line can be improved and auditory easiness of hearing a reproduced sound can be improved.

Also in the above-described area reproduction method, the second angle includes a sixth angle formed by a straight line linking one end portion of the array line and the other end portion of the control line and the array line, and in determination of the spatial frequency, in a case where the first angle θ is smaller than the sixth angle, the spatial frequency kx corresponding to the first angle θ can be determined as a spatial frequency for use in adjustment of the reproduced sound, and in adjustment of the sound pressure of the reproduced sound, a value of the sound pressure Pkx(θ) of the determined spatial frequency kx can be set to be zero.

According to the configuration, in determination of the spatial frequency, in a case where the first angle θ is smaller than the sixth angle formed by a straight line linking one end portion of the array line and the other end portion of the control line and the array line, the spatial frequency kx corresponding to the first angle θ is determined as a spatial frequency for use in adjustment of the reproduced sound. Then, in adjustment of the sound pressure of the reproduced sound, a value of the sound pressure. Pkx(θ) of the determined spatial frequency kx is set to be zero.

Accordingly, in a case where the first angle θ is smaller than the sixth angle formed by a straight line linking the one end portion of the array line and the other end portion of the control line and the array line, a value of the sound pressure Pkx(θ) of the spatial frequency kx corresponding to the first angle θ becomes zero, so that no side lobe is present in a sound pressure distribution in a spatial frequency domain, and therefore, deterioration of area reproduction performance backward of the control line can be improved and auditory easiness of hearing a reproduced sound can be improved.

Additionally, in the above-described area reproduction method, in adjustment of the sound pressure of the reproduced sound, the sound pressure distribution in the spatial frequency domain may be multiplied by a predetermined window function.

According to the configuration, since in the adjustment of a sound pressure of the reproduced sound, the sound pressure distribution in the spatial frequency domain is multiplied by a predetermined window function, no side lobe is present in the sound pressure distribution of the spatial frequency domain, so that deterioration of area reproduction performance backward of the control line can be improved and auditory easiness of hearing a reproduced sound can be improved.

Also in the above-described area reproduction method, the window function may be a rectangular window. According to the configuration, a rectangular window can be used as a window function.

In the above-described area reproduction method, the control line may include a plurality of reproduction lines, to each of which reproduction lines, a different reproduced sound may be output.

According to the configuration, the control line includes a plurality of reproduction lines, and to each of the plurality of reproduction lines, a different reproduced sound is output.

Accordingly, since different reproduced sounds are output to the plurality of reproduction lines, respectively, only one reproduced sound of the plurality of reproduced sounds can be heard on one reproduction line of the plurality of reproduction lines without being interfered by other reproduced sounds output to other reproduction lines.

Also in the above-described area reproduction method, the spatial frequency domain may have no non-physical area.

According to the configuration, since a spatial frequency domain has no non-physical area, a sound pressure of reproduced sound can be adjusted without taking a non-physical area of the spatial frequency domain into consideration.

A computer-readable recording medium which records an area reproduction program according to another aspect of the present disclosure is a computer-readable recording medium which records an area reproduction program for outputting reproduced sound from a speaker array including a plurality of speakers arranged to a predetermined area, the area reproduction program causing a computer to execute processing of converting a sound pressure distribution at each frequency of the reproduced sound from a sound pressure distribution in a frequency domain into that in a spatial frequency domain, the reproduced sound being realized on a control line including a reproduction line in which sound waves emitted from the speaker array intensify with each other and a non-reproduction line in which the sound waves weaken with each other, processing of determining a spatial frequency for use in adjustment of the reproduced sound, in the sound pressure distribution in the spatial frequency domain, based on a positional relationship between the speaker array and the control line, and processing of adjusting a sound pressure of the reproduced sound which is to be output by each of the plurality of speakers using the determined spatial frequency.

According to the configuration, a sound pressure distribution at each frequency of a reproduced sound is converted from a sound pressure distribution in a frequency domain into that in a spatial frequency domain, the reproduced sound being realized on the control line including the reproduction line in which sound waves emitted from the speaker array intensify with each other and the non-reproduction line in which the sound waves weaken with each other. A spatial frequency for use in adjustment of the reproduced sound, in the sound pressure distribution in the spatial frequency domain, is determined based on a positional relationship between the speaker array and the control line. A sound pressure of the reproduced sound which is to be output by each of the plurality of speakers is adjusted using the determined spatial frequency.

Accordingly, since a spatial frequency for use in adjustment of the reproduced sound, in a sound pressure distribution in a spatial frequency domain, is determined based on a positional relationship between the speaker array and the control line, and a sound pressure of the reproduced sound which is to be output by each of the plurality of speakers is adjusted using the determined spatial frequency, limiting a spatial frequency results in decreasing a sound pressure of a non-reproduction area, thereby improving deterioration of area reproduction performance backward of the control line provided near the speaker array.

An area reproduction system according to another aspect of the present disclosure includes a reproduction unit including a speaker array including a plurality of speakers arranged, and a processing unit which adjusts a sound pressure of a reproduced sound to be output by each of the plurality of speakers based on a control line including a reproduction line in which sound waves emitted from the speaker array intensify with each other and a non-reproduction line in which the sound waves weaken with each other, and causes the processing unit to output the reproduced sound, in which the processing unit converts a sound pressure distribution at each frequency of the reproduced sound to be realized on the control line from a sound pressure distribution in a frequency domain into that in a spatial frequency domain, determines a spatial frequency for use in adjustment of the reproduced sound, in the sound pressure distribution in the spatial frequency domain, based on a positional relationship between the speaker array and the control line, and adjusts a sound pressure of the reproduced sound which is to be output by each of the plurality of speakers using the determined spatial frequency.

According to the configuration, a sound pressure distribution at each frequency of a reproduced sound is converted from a sound pressure distribution in a frequency domain into that in a spatial frequency domain, the reproduced sound being realized on the control line including the reproduction line in which sound waves emitted from the speaker array intensify with each other and the non-reproduction line in which the sound waves weaken with each other. A spatial frequency for use in adjustment of the reproduced sound, in the sound pressure distribution in the spatial frequency domain, is determined based on a positional relationship between the speaker array and the control line. A sound pressure of the reproduced sound which is to be output by each of the plurality of speakers is adjusted using the determined spatial frequency.

Accordingly, since a spatial frequency for use in adjustment of reproduced sound, in a sound pressure distribution in a spatial frequency domain, is determined based on a positional relationship between the speaker array and the control line, and a sound pressure of the reproduced sound which is to be output by each of the plurality of speakers is adjusted using the determined spatial frequency, limiting a spatial frequency results in decreasing a sound pressure of a non-reproduction area, thereby improving deterioration of area reproduction performance backward of the control line provided near the speaker array.

EMBODIMENTS

In the following, embodiments of the present disclosure will be described with reference to the accompanying drawings. The following embodiments are among specific examples of the present disclosure and do not limit a technical range of the present disclosure.

First, an overall configuration of an area reproduction system in the embodiment of the present disclosure will be described.

FIG. 1 is a diagram showing a configuration of the area reproduction system in the embodiment of the present disclosure. An area reproduction system 1 shown in FIG. 1 includes an input unit 10, a data unit 20, a processing unit 30, and a reproduction unit 40.

The input unit 10 is a terminal device including a touch panel 101 for conducting various designation operations of sound source data 201 of reproduced sound to be reproduced by a speaker 403 to be described later, a reproduction condition to be described later, a reproduced sound volume, and the like. The input unit 10 may be a terminal device including, not limited to the touch panel 101, a physical switch, a keyboard, a mouse, and a display device.

The input unit 10 may be a terminal device such as a smartphone, a tablet type computer, a personal computer, or the like used by a user of the area reproduction system 1, or a terminal device such as a personal computer provided in a room as a target of area reproduction by the area reproduction system 1 and used in common by a plurality of users.

The data unit 20 is a storage device such as a semiconductor memory, a hard disk drive (HDD), or the like. The data unit 20 stores the sound source data 201. The sound source data 201 is stored in the data unit 20 via a network, for example, the Internet or the like. The data unit 20 may be provided in the same device as that of the processing unit 30 to be described later or provided in a device different from the processing unit 30.

The processing unit 30 is an information processing unit including a microprocessor, a digital signal processor (DSP), a read only memory (ROM), a random access memory (RAM), an HDD, and the like. The processing unit 30 includes a filter generation portion 301, a convolution portion 302, and an audio interface (IF) 303.

The filter generation portion 301 generates a control filter for realizing area reproduction under a reproduction condition designated by a user using the input unit 10.

The convolution portion 302 generates a drive signal obtained by convoluting a control filter generated by the filter generation portion 301 into a reproduced sound signal (hereinafter, referred to as a reproduced sound signal corresponding to the sound source data 201) which is an analog signal converted from the sound source data 201 designated by the user using the input unit 10.

The audio IF 303 outputs a drive signal generated by the convolution portion 302 to the reproduction unit 40.

The reproduction unit 40 is an audio output device including a DA converter 401 which converts a drive signal input from the audio IF 303 into an analog signal, an amplifier 402 which amplifies an analog signal converted by the DA converter 401 (hereinafter, referred to as reproduced sound signal), and the speaker 403 which outputs reproduced sound represented by a reproduced sound signal which is amplified by the amplifier 402.

The reproduction unit 40 includes a plurality of speakers 403. Arranging the plurality of speakers 403 at a predetermined interval in a straight line forms a speaker array. As will be described later, area reproduction performance varies with an arrangement interval of the respective speakers 403, an entire length of a speaker array, and the like. A kind or scale of the speaker 403 is not limited. While in the present embodiment, the plurality of speakers 403 are arranged in a straight line, the present disclosure is not limited thereto and the plurality of speakers 403 can be arranged in circle.

Figure 2:
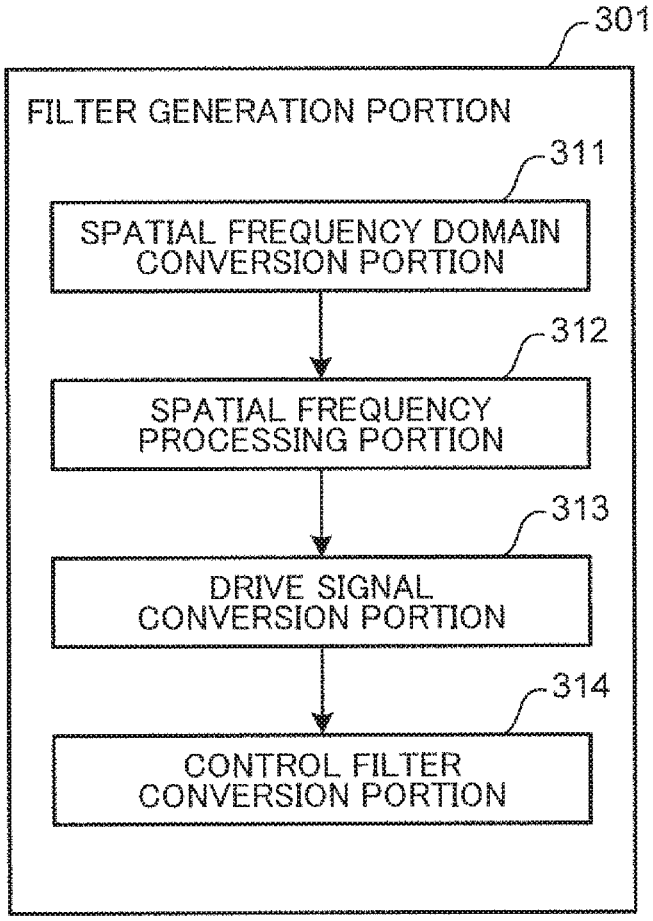
FIG. 2 is a diagram showing an internal configuration of a filter generation portion in the embodiment of the present disclosure.

Next, the filter generation portion 301 will be detailed. FIG. 2 is a diagram showing an internal configuration of the filter generation portion in the embodiment of the present disclosure.

As shown in FIG. 2, the filter generation portion 301 includes a spatial frequency domain conversion portion 311, a spatial frequency processing portion 312, a drive signal conversion portion 313, and a control filter conversion portion 314.

The spatial frequency domain conversion portion 311 converts a sound pressure distribution at each frequency of reproduced sound from a sound pressure distribution in a frequency domain into that in a spatial frequency domain, the reproduced sound being realized on a control line including a reproduction line in which sound waves emitted from the speaker array intensify with each other and a non-reproduction line in which the sound waves weaken with each other.

A spatial frequency domain has no non-physical area. The non-physical area is an area in which a relation of $|f2|>\rho|f1|$ is satisfied in a two-dimensional frequency plane, in which $\rho=D/cT$, T represents a sampling interval, D represents an interval of speakers, c represents sound velocity, f1 represents normalized time frequency, and f2 represents normalized spatial frequency.

The spatial frequency processing portion 312 determines a spatial frequency for use in adjustment of the reproduced sound, in a sound pressure distribution in the spatial frequency domain, based on a positional relationship between the speaker array and the control line. The spatial frequency processing portion 312 adjusts a sound pressure of the reproduced sound which is to be output by each of the plurality of speakers 403 using the determined spatial frequency.

The drive signal conversion portion 313 converts a sound pressure distribution in a spatial frequency domain into a drive signal.

The control filter conversion portion 314 converts a drive signal (control filter) of a spatial frequency domain into a drive signal (control filter) of a frequency domain and outputs the converted drive signal (control filter) of the frequency domain.

Next, a control filter generation method by the filter generation portion 301 will be described. In the following, the plurality of speakers 403 forming the speaker array are assumed to be arranged on an x axis. In a plane represented by the x axis and a y axis orthogonal to the x axis, a sound pressure $P(x, y_{ref}, \omega)$ of a reproduced sound with an angular frequency ω is given by Formula (3) below, the reproduced sound reaching a control point $B(x, y_{ref})$ among reproduced sounds with the angular frequency ω which are output from the speaker 403 at a position $A(x_0, 0)$ of the speaker array:

$$P(x,y_{ref},\omega)=\int_{-\infty}^{\infty}D)(x_0,0,\omega)G(x-x_0,y_{ref},\omega)dx_0 \quad (3)$$

The sound pressure $P(x, y_{ref}, \omega)$ is a value in a frequency domain. In Formula (3), $D(x_0, 0, \omega)$ represents a drive signal of each speaker, and $G(x-x_0, y_{ref}, \omega)$ represents a transfer function from each the speaker 403 to the control point $B(x, y_{ref})$. The transfer function $G(x-x_0, y_{ref}, \omega)$ is a Green's function in a three-dimensional free space. With a frequency of a reproduced sound represented as f, an angular frequency ω of the reproduced sound is represented by $2\pi f(\omega=2\pi f)$.

The spatial frequency domain, conversion portion 311 converts a sound pressure distribution at each frequency of reproduced sound from a sound pressure distribution in a frequency domain into that in a spatial frequency domain by performing Fourier transformation of the above-described. Formula (3), the reproduced sound being realized on the control line. Fourier transformation of Formula (3) in an x axis direction based on a convolution theorem obtains Formula (4) below:

$$\tilde{P}(k_x,y_{ref},\omega)=\tilde{D}(k_x,\omega)\cdot\tilde{G}(k_x,y_{ref},\omega) \quad (4)$$

Here, "~" attached to "P", "D", and "G" in Formula (4) represents a value in a spatial frequency domain. kx represents a spatial frequency in the x axis direction.

The spatial frequency processing portion 312 determines a spatial frequency for use in the adjustment of a reproduced sound based on an angle (the first angle) formed by a plane wave represented by a spatial frequency and an array line along the speaker array and an angle (the second angle) represented by a straight line linking one point on the array line and one point on the control line and by the array line.

Figure 3:
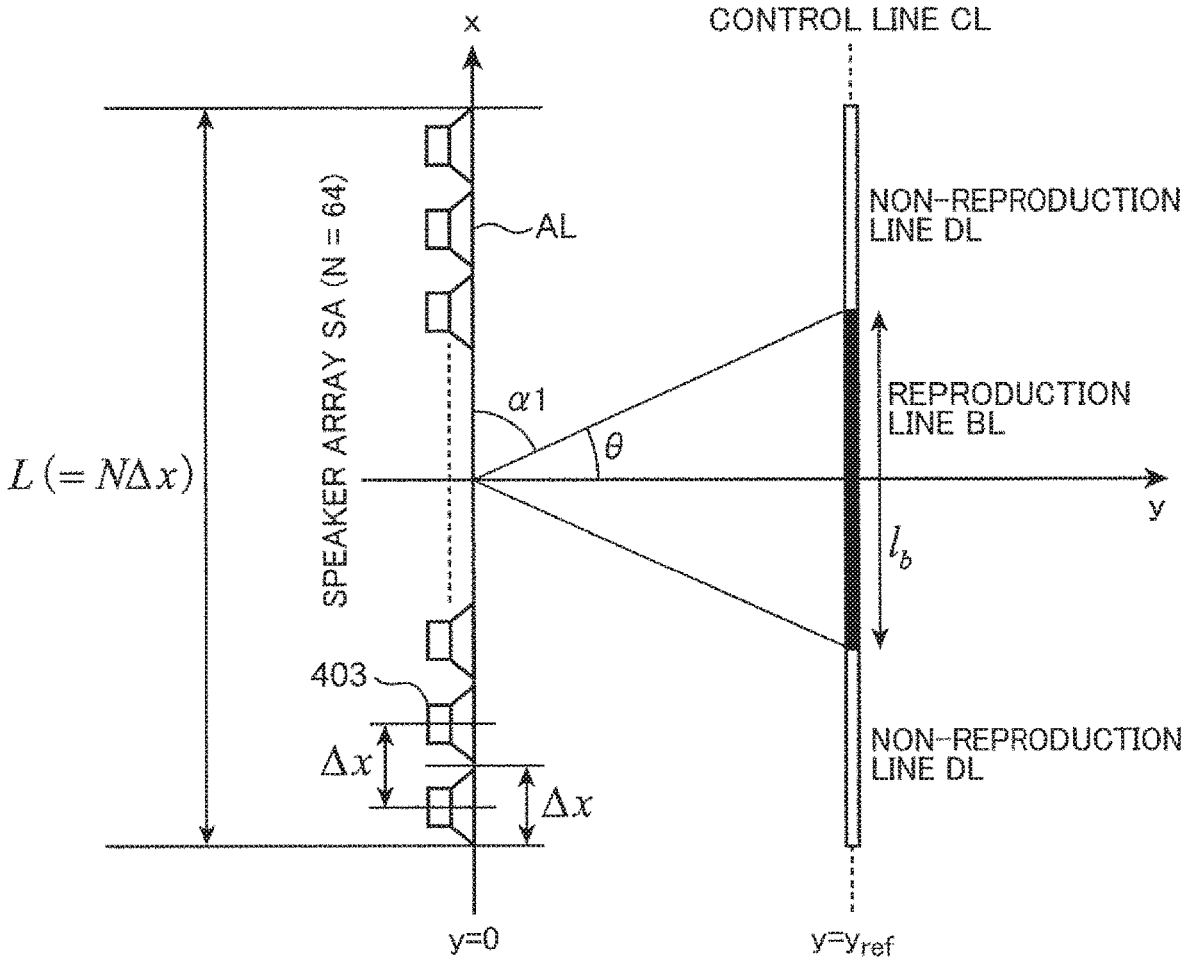
FIG. 3 is a schematic diagram for describing processing of determining a spatial frequency for use in adjustment of reproduced sound in the present embodiment.

FIG. 3 is a schematic diagram for describing processing of determining a spatial frequency for use in adjustment of a reproduced sound in the present embodiment. For realizing area reproduction, it is only necessary to settle a reproduction line BL in which sound waves emitted from a speaker array SA intensify with each other and a non-reproduction line DL in which the sound waves weaken with each other on a control line CL substantially parallel to the speaker array SA and set at a position spaced apart from an array line AL along the speaker array SA by a distance $y_{ref}$ as shown in FIG. 3.

The spatial frequency kx is represented by Formula (5) below:

$$kx=2\pi n/(N\Delta x) \quad (5)$$

In the above formula, N represents the number of the plurality of speakers 403. n represents an integer and a relation of $-N/2\leq n\leq N/2-1$ is satisfied. Δx represents an interval between adjacent speakers 403 among the plurality of speakers 403.

An angle θ formed by a plane wave represented by the spatial frequency kx and the array line AL is represented by Formula (6) below:

$$\theta=180/\pi a\ \sin(kx/(\omega/c)) \quad (6)$$

In the above formula, ω represents angular frequency and c represents sound velocity.

In a case where the angle θ is smaller than an angle α1 (the third angle) formed by a straight line linking the center of the array line AL and one end portion of the reproduction line BL and the array line AL, the spatial frequency processing portion 312 determines a spatial frequency kx corresponding to the angle θ as a spatial frequency for use in the adjustment of reproduced sound. Then, the spatial frequency processing portion 312 sets a value of the sound pressure Pkx(θ) of the determined spatial frequency kx to be zero.

While in the present embodiment, the control line CL is linear, the present disclosure is not limited thereto and the control line CL may be circular.

Figure 4:
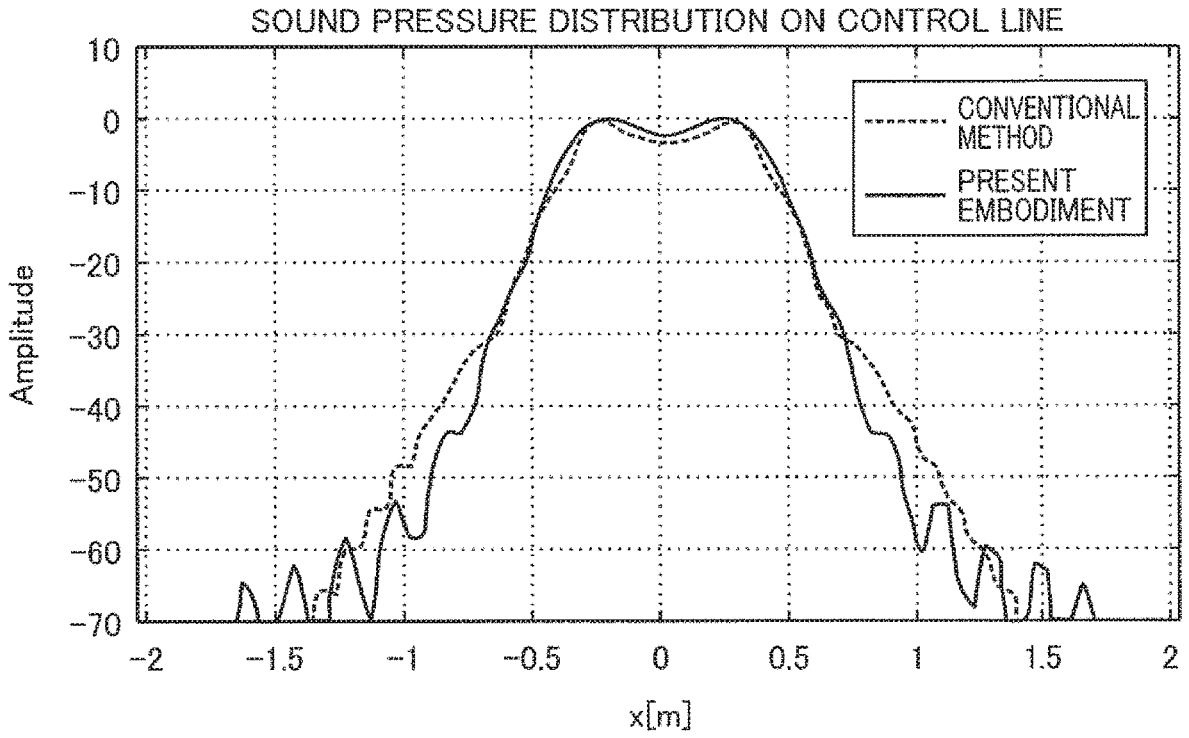
FIG. 4 is a diagram showing one example of a sound pressure distribution on a control line in a frequency domain in the present embodiment.
Figure 5:
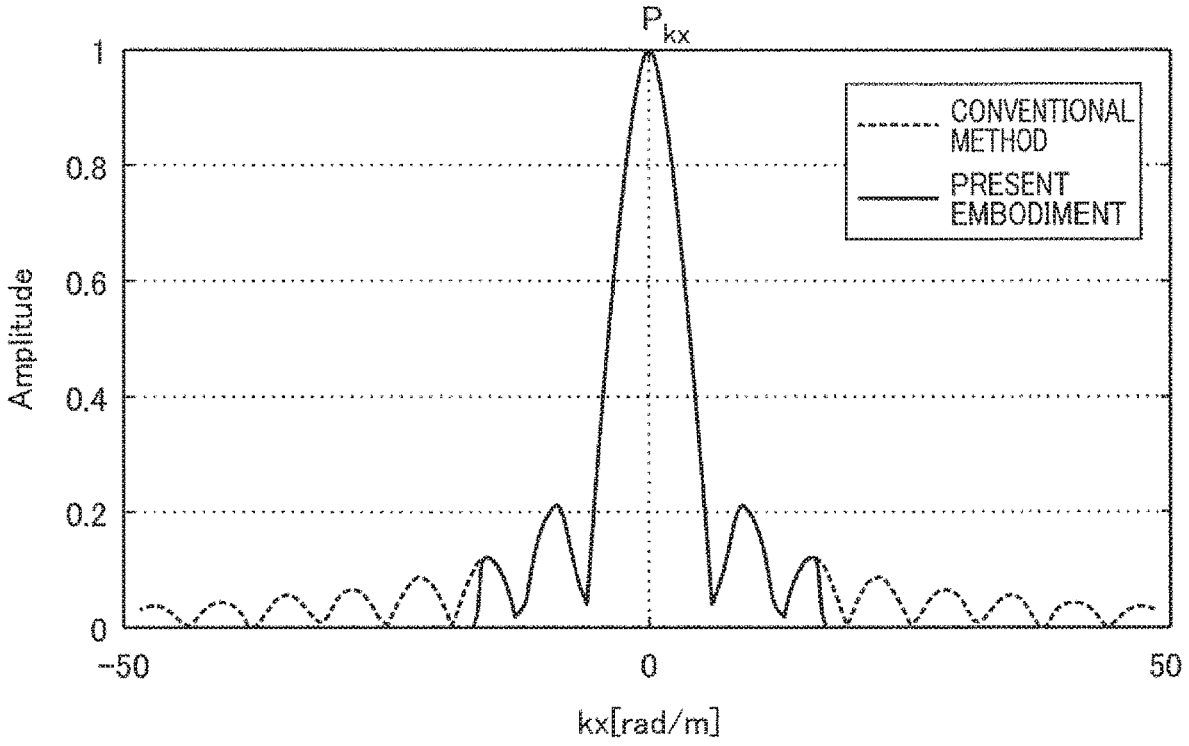
FIG. 5 is a diagram showing one example of a sound pressure distribution on a control line in a spatial frequency domain in the present embodiment.

FIG. 4 is a diagram showing one example of a sound pressure distribution on a control line in a frequency domain in the present embodiment, and FIG. 5 is a diagram showing one example of a sound pressure distribution on a control line in a spatial frequency domain in the present embodiment. In each of FIG. 4 and FIG. 5, a broken line denotes an area reproduction method according to a conventional technique and a solid line denotes an area reproduction method according to the present embodiment.

As shown in FIG. 4, a sound pressure of the non-reproduction line DL on the control line CL is suppressed in a frequency domain in the conventional technique. In a ease where the sound pressure distribution shown in FIG. 4 is converted from a frequency domain to a spatial frequency domain, in the conventional technique, a sound pressure of the non-reproduction line DL on the control line CL remains in the spatial frequency domain as shown in FIG. 5. On the other hand, a sound pressure of the non-reproduction line DL on the control line CL is zero in the spatial frequency domain in the present embodiment.

Subsequently, the drive signal conversion portion 313 converts the sound pressure distribution in the spatial frequency domain to a drive signal in the spatial frequency domain using the above-described Formula (4). The drive signal in the spatial frequency domain is represented by Formula (7) below:

$$\tilde{D}(k_x,\omega)=\frac{\tilde{P}(k_x,y_{ref},\omega)}{\tilde{G}(k_x,y_{ref},\omega)} \quad (7)$$

With a reproduced sound signal to be output by the speaker 403 represented as S(ω) and a control filter represented as $F(x_0, 0, \omega)$, a drive signal $D(x_0, 0, \omega)$ of a speaker at point A is represented by Formula (8) below:

$$D(x_0,0,\omega)=S(\omega)F(x_0 0,\omega) \quad (8)$$

Since the control filter $F(x_0, 0, \omega)$ does not depend on a reproduced sound, it is assumed that a relation of S(ω)=1 is satisfied hereinafter. Accordingly, Formula (9) below is obtained from a result of Fourier transformation of Formula (8) in the x axis direction and Formula (4):

$$\tilde{F}(k_x, \omega) = \frac{\tilde{P}(k_x, y_{ref}, \omega)}{\tilde{G}(k_x, y_{ref}, \omega)} \tag{9}$$

The control filter F(x, 0, ω) which realizes area reproduction can be analytically derived by inverse Fourier transformation of a control filter in a spatial frequency domain as in Formula (10) below:

$$F(x, 0, \omega) = F^{-1}\left[\frac{\tilde{P}(k_x, y_{ref}, \omega)}{\tilde{G}(k_x, y_{ref}, \omega)}\right] \tag{10}$$

$F^{-1}$[ ] on the right-hand side represents inverse Fourier transformation, and an expression in [ ] represents a control filter in a spatial frequency domain.

Formula (10) is obtained on the assumption that the speakers 403 provided in the speaker array SA are unlimitedly arranged on the x axis. In practice, the number of speakers 403 provided in the speaker array SA is limited and therefore, the control filter F(x, 0, ω) should be derived discretely.

Specifically, the number of the speakers 403 provided in the speaker array SA is represented as N, an arrangement interval between the respective speakers 403 is represented as Δx, and a length of the speaker array SA (the array line AL) in the x axis direction is represented as Las shown in FIG. 3. In this case, the discrete control filter F(x, 0, ω) can be analytically derived by discrete inverse Fourier transformation of a control filter in a spatial frequency domain represented by the expression in [ ] on the right-hand side of Formula (10) as in Formula (11) below:

$$F(x, 0, \omega) = \frac{1}{L}\sum_{m=-N/2}^{N/2-1}\left(\frac{\tilde{P}(k_x, y_{ref}, \omega)}{\tilde{G}(k_x, y_{ref}, \omega)}\right)\exp\left(\frac{2\pi jnm}{N}\right) \tag{11}$$

where $$x = n\Delta x \quad (-N/2 \le n \le N/2 - 1),$$

$$L = N\Delta x, \qquad k_x = 2\pi m/N\Delta x$$

The control filter conversion portion 314 generates the control filter F(x, 0, ω) by substituting an arrangement interval Δx between the respective speakers 403, the number N of the speakers 403 provided in the speaker array SA, and the distance $y_{ref}$ from the speaker array SA to the control line CL in a y axis direction for Formula (11). Thus, by performing inverse Fourier transformation of a drive signal in the spatial frequency domain, the control filter conversion portion 314 converts the drive signal into a control filter in a frequency domain. The control filter conversion portion 314 outputs the control filter in the frequency domain to the convolution portion 302.

Figure 6:
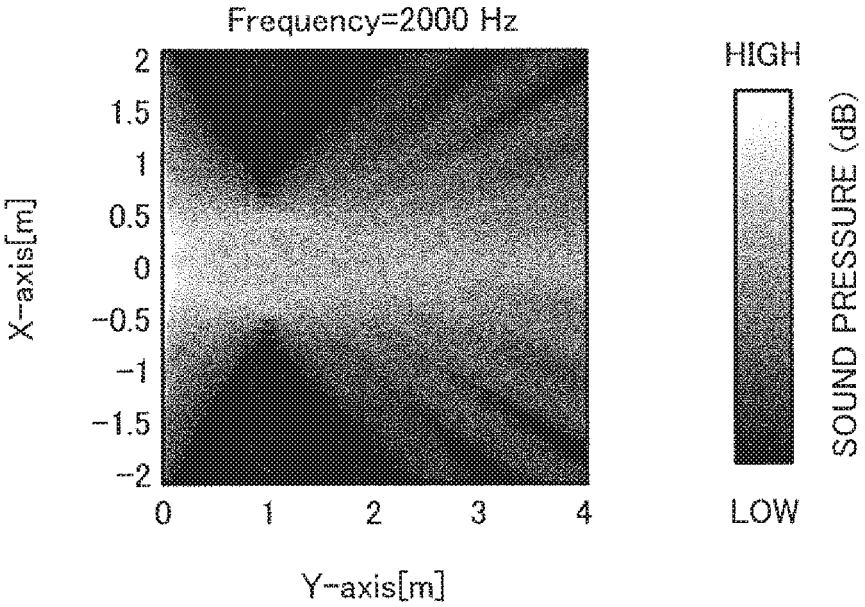
PRIOR ART FIG. 6
FIG. 6 is a diagram showing a sound pressure distribution in an x-y plane reproduced by an area reproduction method according to a conventional technique.
Figure 7:
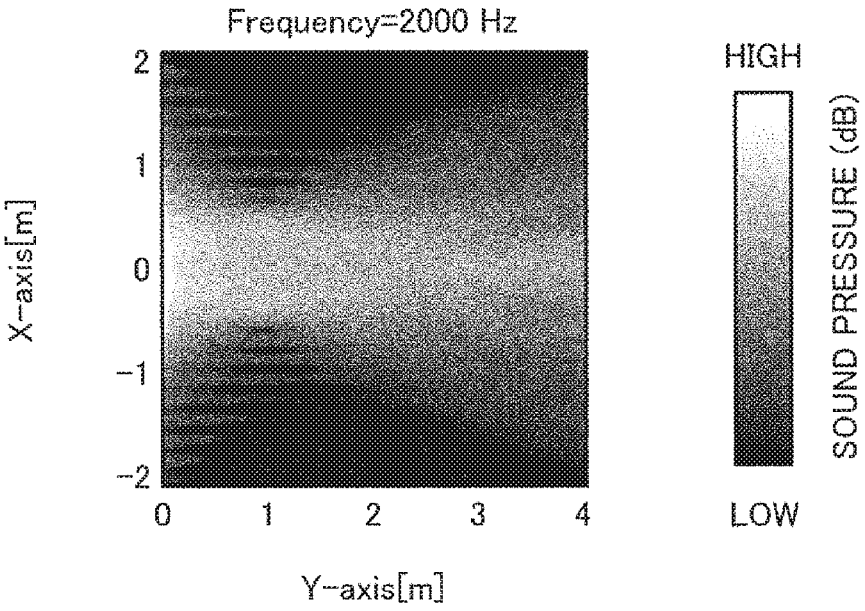
FIG. 7 is a diagram showing a sound pressure distribution in an x-y plane reproduced by an area reproduction method according to the present embodiment.

FIG. 6 is a diagram showing a sound pressure distribution in an x-y plane reproduced by an area reproduction method according to a conventional technique, and FIG. 7 is a diagram showing a sound pressure distribution in an x-y plane reproduced by an area reproduction method according to the present embodiment. In FIG. 6 and FIG. 7, it is assumed that 64 (N=64) of the speakers 403 with a width of 35 mm are arranged on the x axis to form the speaker array SA. It is also assumed that the arrangement interval Δx between the respective speakers 403 is 35 mm. It is further assumed that a line orthogonal to the center of the array line AL along the speaker array SA in the x axis direction is the y axis and the distance $y_{ref}$ from the speaker array SA to the control line CL is 1 m. It is also assumed that a width 1*b* of the reproduction line BL on the control line CL is 2 m and the center of the reproduction line BL in the x axis direction is on the y axis (x=0).

While in the conventional technique shown in FIG. 6, a reproduced sound emitted from the speaker array SA is heard only at the reproduction line BL on the control line CL to realize appropriate area reproduction, area reproduction performance backward of the control line CL is deteriorated. On the other hand, in the present embodiment shown in FIG. 7, a reproduced sound emitted from the speaker array SA has a sound pressure in a non-reproduction area reduced not only on the control line CL but also backward of the control line CL, so that deterioration of area reproduction performance backward of the control line CL can be improved. Additionally, since no side lobe is present in a sound pressure distribution in a spatial frequency domain, auditory easiness of hearing a reproduced sound can be improved.

Subsequently, in the present embodiment, adjustment operation of a reproduced sound to be output by the speaker 403 will be described.

Figure 8:
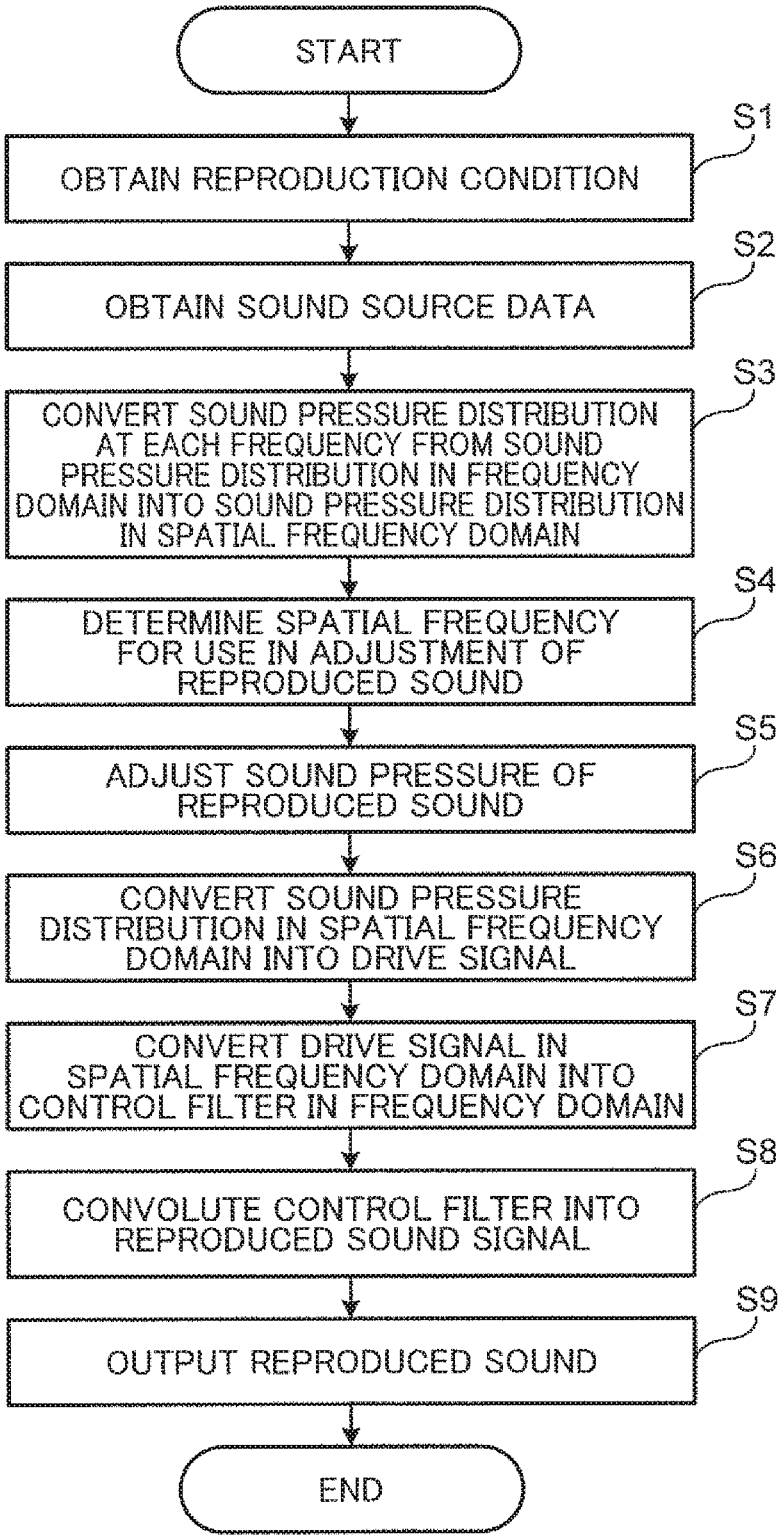
FIG. 8 is a flow chart showing one example of reproduced sound adjustment operation in the present embodiment.

FIG. 8 is a flow chart showing one example of reproduced sound adjustment operation in the present embodiment.

First, in step S1, the filter generation portion 301 of the processing unit 30 obtains a reproduction condition from the input unit 10. When a user designates a reproduction condition using the touch panel 101, the input unit 10 transmits the designated reproduction condition to the processing unit 30. The filter generation portion 301 receives the reproduction condition transmitted by the input unit 10.

Reproduction conditions designated by a user include a condition necessary for generation of the control filter F(x, 0, ω). The reproduction conditions include, for example, the arrangement interval Δx between the respective speakers 403, the number N of the speakers 403 provided in the speaker array SA, the distance $y_{ref}$ from the speaker array SA to the control line CL in the y axis direction, the width lb of the reproduction line BL, and a sound volume of a reproduced sound on the reproduction line BL. The reproduction conditions may include a width of the control line CL. The reproduction conditions may not include a part or all of the above-described conditions.

Next, in step S2, the filter generation portion 301 of the processing unit 30 obtains sound source data from the data unit 20. When the user designates a name (hereinafter, a sound source name) of the sound source data 201 of the reproduced sound using the touch panel 101, the input unit 10 transmits the designated sound source name to the data unit 20. When receiving the sound source name from the input unit 10, the data unit 20 transmits sound source data 201 corresponding to the sound source name to the processing unit 30. The filter generation portion 301 receives the sound source data transmitted by the data unit 20.

Next, in step S3, the spatial frequency domain conversion portion 311 of the filter generation portion 301 converts a sound pressure distribution at each frequency of a reproduced sound from a sound pressure distribution in a frequency domain into that in a spatial frequency domain, the reproduced sound being realized on the control line CL, by performing Fourier transformation of the above-described Formula (3).

Next, in step S4, the spatial frequency processing portion 312 determines a spatial frequency for use in adjustment of the reproduced sound, in a sound pressure distribution in the spatial frequency domain, based on a positional relationship between the speaker array SA and the control line CL. In the present embodiment, in a case where the angle θ is smaller than an angle α1 formed by a straight line linking the center of the array line AL and one end portion of the reproduction line and the array line AL, the spatial frequency processing portion 312 determines a spatial frequency kx corresponding to the angle θ as a spatial frequency for use in the adjustment of the reproduced sound.

Next, in step S5, the spatial frequency processing portion 312 adjusts a sound pressure of the reproduced sound which is to be output by each of the plurality of speakers 403 using the determined spatial frequency. Then, the spatial frequency processing portion 312 sets a value of the sound pressure Pkx(θ) of the determined spatial frequency kx to be zero.

Next, in step S6, the drive signal conversion portion 313 converts the sound pressure distribution in the spatial frequency domain into a drive signal in the spatial frequency domain.

Next, in step S7, the control filter conversion portion 314 converts the drive signal in the spatial frequency domain into a control filter in a frequency domain by discrete inverse Fourier transformation of the drive signal in the spatial frequency domain. The control filter conversion portion 314 generates the control filter F(x, 0, ω) by substituting the arrangement interval Δx between the respective speakers 403, the number N of the speakers 403 provided in the speaker array SA, and the distance $y_{ref}$ from the speaker array SA to the control line CL in the y axis direction for the above-described Formula (11).

In a case where the reproduction conditions obtained in step S1 include a sound volume of a reproduced sound on the reproduction line BL, the control filter conversion portion 314 may generate, as the control filter F(x, 0, ω), r·F(x, 0, ω) which is a result obtained by multiplying the generated control filter F(x, 0, ω) by a ratio r of a sound volume of a reproduced sound indicated by a reproduction condition to a predetermined maximum sound volume (ratio r=sound volume of reproduced sound/maximum sound volume).

There is also a case where a part or all of the above-described reproduction conditions obtained in step S1 as described above are not included. For example, in a case where the arrangement interval Δx between the respective speakers 403 and the number N of the speakers 403 provided in the speaker array SA are not included in the reproduction conditions, the control filter conversion portion 314 may obtain the arrangement interval Δx between the respective speakers 403 and the number N of the speakers 403 provided in the speaker array SA which are stored in advance from a ROM or the like.

In a case where the distance $y_{ref}$ from the speaker array SA to the control line CL in the y axis direction is not included in the reproduction conditions, the control filter conversion portion 314 may obtain information about a position of a person from a predetermined sensor not shown which is included in the area reproduction system 1 or externally provided. Then, the control filter conversion portion 314 may set a condition of the distance $y_{ref}$ for setting the control line CL based on the obtained information about the position of the person.

Specifically, the above-described predetermined sensor includes, for example, a camera, a sensor which obtains a thermal image, or the like. The above-described predetermined sensor may be incorporated into the same device as that of the reproduction unit 40, or provided outside of the area reproduction system 1. The above-described predetermined sensor at least needs to transmit an output signal to the processing unit 30.

For example, it is assumed that as the above-described predetermined sensor, a camera not shown which images the y axis direction is provided on the same x axis as the speaker array SA. In this case, the control filter conversion portion 314 obtains a captured image output by the camera and recognizes whether the captured image includes a person using a known image recognition technique or the like. Then, when recognizing that the captured image includes a person, the control filter conversion portion 314 calculates a distance in the y axis direction from the x axis to a position of the recognized person based on a ratio of a size of an image showing the recognized person to a size of the captured image, or the like.

It is also assumed that as the above-described predetermined sensor, a sensor (e.g. a depth sensor) is provided which is capable of measuring a distance in the y axis direction from the x axis to a position of the person and outputting a signal indicative of the measured distance to the processing unit 30. In this case, the control filter conversion portion 314 obtains a distance in the y axis direction from the x axis to the position of the person indicated by an output signal of the sensor.

Then, the control filter conversion portion 314 sets the distance in the y axis direction from the x axis to the position of the person as the distance $y_{ref}$ from the speaker array SA to the control line CL in the y axis direction.

In a case where the width lb of the reproduction line BL is not included in the reproduction conditions, the control filter conversion portion 314 may obtain a fixed value (e.g. 1 m) stored in advance and set in advance to be, for example, on the order of a lateral width of a person from a ROM or the like.

Thus, the control filter conversion portion 314 allows automatic setting of a reproduction condition based on information about a position of a person obtained front a predetermined sensor without user's labor to designate a reproduction condition necessary for setting the control line CL. This enables the control filter conversion portion 314 to automatically set the control line CL.

Next, in step S8, the convolution portion 302 generates the drive signal D(x, 0, 2πf) (i.e. D(x, 0, 2πf)=S(2πf)F(x, 0, 2πf)) with the control filter F(x, 0, 2πf) generated by the filter generation portion 301 convoluted into a reproduced sound signal S(2πf) corresponding to the obtained sound source data 201. The convolution portion 302 transmits the generated drive signal D(x, 0, 2πf) to the reproduction unit 40.

Next, in step S9, by driving each speaker 403 by the received drive signal D(x, 0, 2πf), the reproduction unit 40 causes each speaker 403 to output a reproduced sound.

Subsequently, a first modification of the present embodiment will be described. In the above-described embodiment, in a case where the angle θ is smaller than the angle α1 formed by a straight line linking the center of the array line AL and one end portion of the reproduction line BL and the array line AL, the angle θ being formed by a plane wave represented by the spatial frequency and the array line AL, the spatial frequency processing portion 312 determines the spatial frequency kx corresponding to the angle θ as a spatial frequency for use in the adjustment of the reproduced sound. By contrast, in the first modification of the present embodiment, in a case where the angle θ is smaller than the angle (the fourth angle) formed by a straight line linking the center of the array line AL and one end portion of the control line CL and the array line AL, the spatial frequency processing portion 312 determines the spatial frequency kx corresponding to the angle θ as a spatial frequency for use in the adjustment of reproduced sound.

Figure 9:
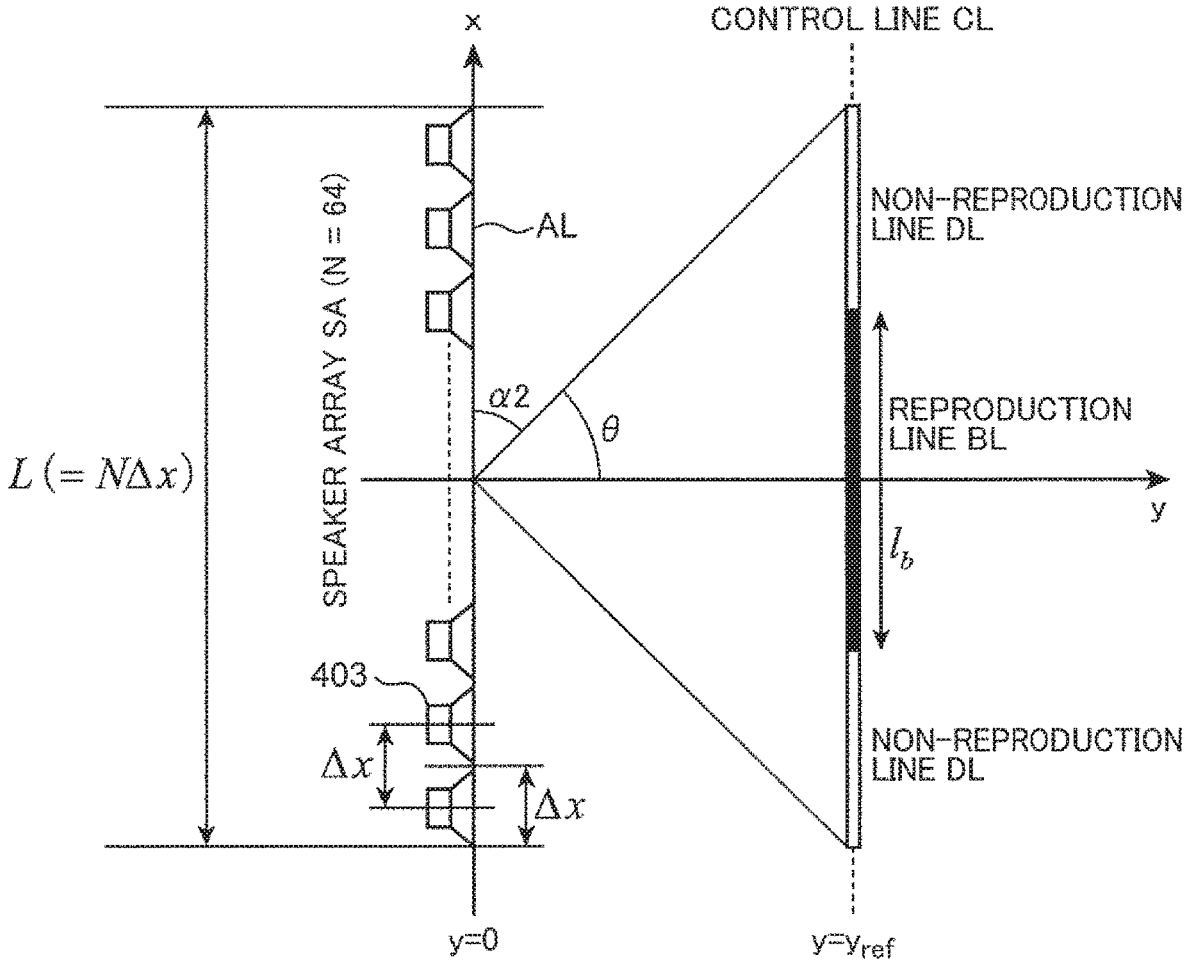
FIG. 9 is a schematic diagram for describing processing of determining a spatial frequency for use in adjustment of reproduced sound in a first modification of the present embodiment.

FIG. 9 is a schematic diagram for describing processing of determining a spatial frequency for use in adjustment of reproduced sound in the first modification of the present embodiment.

In the first modification of the present embodiment, the spatial frequency kx is represented by the above-described Formula (5) and the angle θ formed by a plane wave represented by the spatial frequency kx and the array line AL is represented by the above-described Formula (6).

In a case where the angle θ is smaller than an angle α2 formed by the straight line linking the center of the array line AL and one end portion of the control line CL and the array line AL, the spatial frequency processing portion 312 determines the spatial frequency kx corresponding to the angle θ as a spatial frequency for use in the adjustment of reproduced sound. Then, the spatial frequency processing portion 312 sets a value of the sound pressure Pkx(θ) of the determined spatial frequency kx to be zero.

Figure 10:
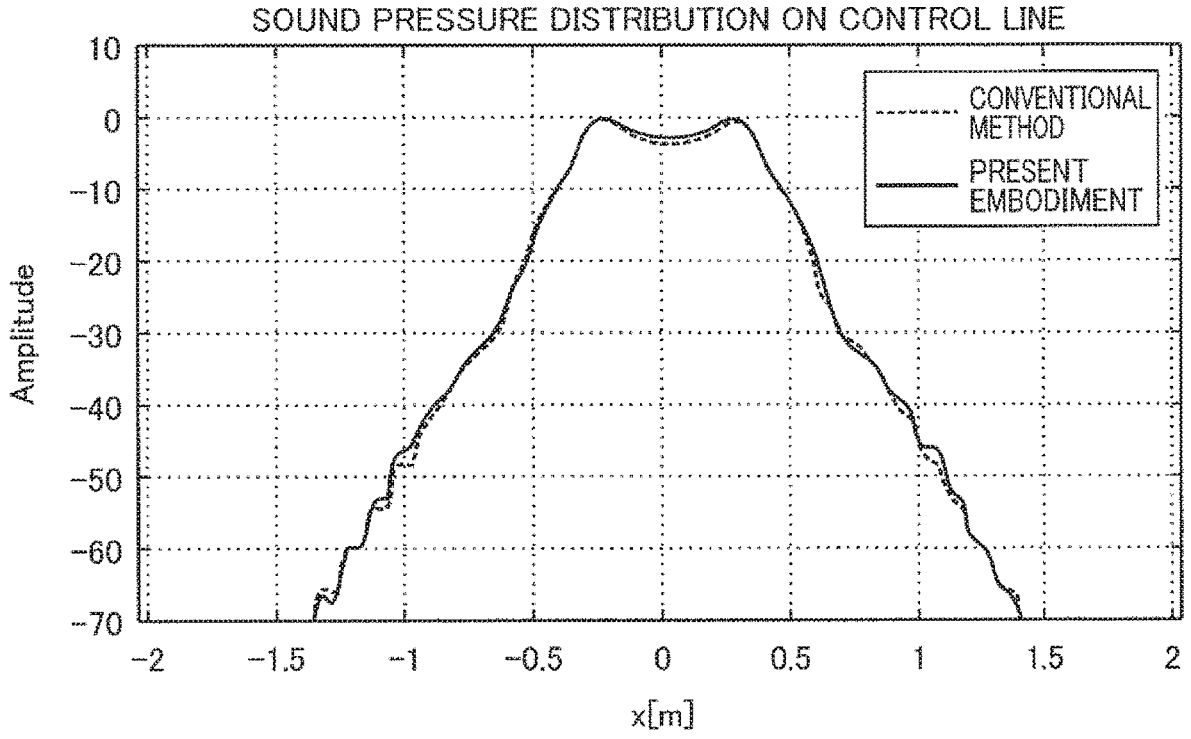
FIG. 10 is a diagram showing one example of a sound pressure distribution on a control line in a frequency domain in the first modification of the present embodiment.
Figure 11:
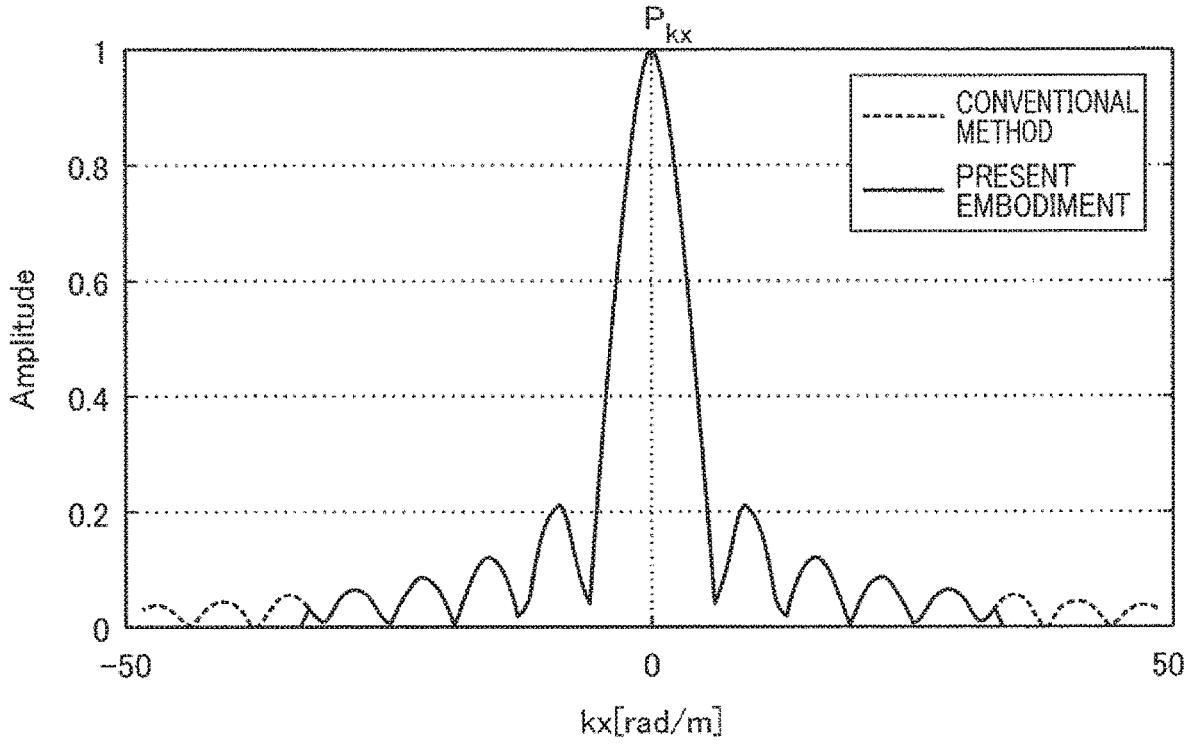
FIG. 11 is a diagram showing one example of a sound pressure distribution on a control line in a spatial frequency domain in the first modification of the present embodiment.

FIG. 10 is a diagram showing one example of a sound pressure distribution on a control line in a frequency domain in the first modification of the present embodiment, and FIG. 11 is a diagram showing one example of a sound pressure distribution on a control line in a spatial frequency domain in the first modification of the present embodiment. In each of FIG. 10 and FIG. 11, a broken line denotes an area reproduction method according to a conventional technique and a solid line denotes an area reproduction method according to the present embodiment.

As shown in FIG. 10, in the conventional technique, a sound pressure of the non-reproduction line DL on the control line CL is suppressed in a frequency domain. In a case where the sound pressure distribution shown in FIG. 10 is converted from a sound pressure distribution in a frequency domain into that in a spatial frequency domain, all the sound pressures of the non-reproduction line DL on the control line CL remain in a spatial frequency domain in the conventional technique as shown in FIG. 11. By contrast, in the first modification of the present embodiment, a sound pressure of a part of the non-reproduction line DL on the control line CL is zero in a spatial frequency domain.

Figure 12:
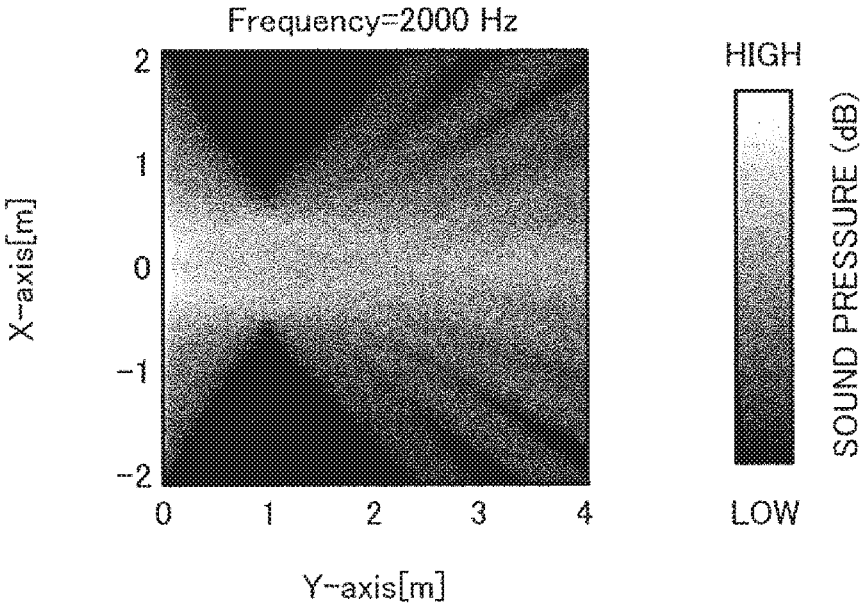
FIG. 12 is a diagram showing a sound pressure distribution in an x-y plane reproduced by an area reproduction method according to the first modification of the present embodiment.

FIG. 12 is a diagram showing a sound pressure distribution in an x-y plane reproduced by the area reproduction method according to the first modification of the present embodiment. In FIG. 12, it is assumed that 64 (N=64) of the speakers 403 with a width of 35 mm are arranged on the x axis to form the speaker array SA. It is also assumed that the arrangement interval Δx between the respective speakers 403 is 35 mm. It is further assumed that a line orthogonal to the center of the speaker array SA in the x axis direction is the y axis and the distance $y_{ref}$ from the speaker array SA to the control line CL is 1 m. It is also assumed that a width lb of the reproduction line BL on the control line CL is 2 m and the center of the reproduction line BL in the x axis direction is on the y axis (x=0).

While in the conventional technique shown in FIG. 6, a reproduced sound emitted from the speaker array SA is heard only at the reproduction line BL on the control line CL to realize appropriate area reproduction, area reproduction performance backward of the control line CL is deteriorated. On the other hand, in the first modification of the present embodiment shown in FIG. 12, a reproduced sound emitted from the speaker array SA has a sound pressure in a non-reproduction area reduced not only on the control line CL but also backward of the control line CL, so that deterioration of area reproduction performance backward of the control line CL can be improved. Additionally, since no side lobe is present in a sound pressure distribution in a spatial frequency domain, auditory easiness of hearing a reproduced sound can be improved.

Subsequently, a second modification of the present embodiment will be described. In the second modification of the present embodiment, in a case where the angle θ is smaller than an angle (the fifth angle) formed by a straight line linking one end portion of the array line AL and the other end portion of the reproduction line BL and the array line AL, the spatial frequency processing portion 312 determines the spatial frequency kx corresponding to the angle θ as a spatial frequency for use in the adjustment of reproduced sound.

Figure 13:
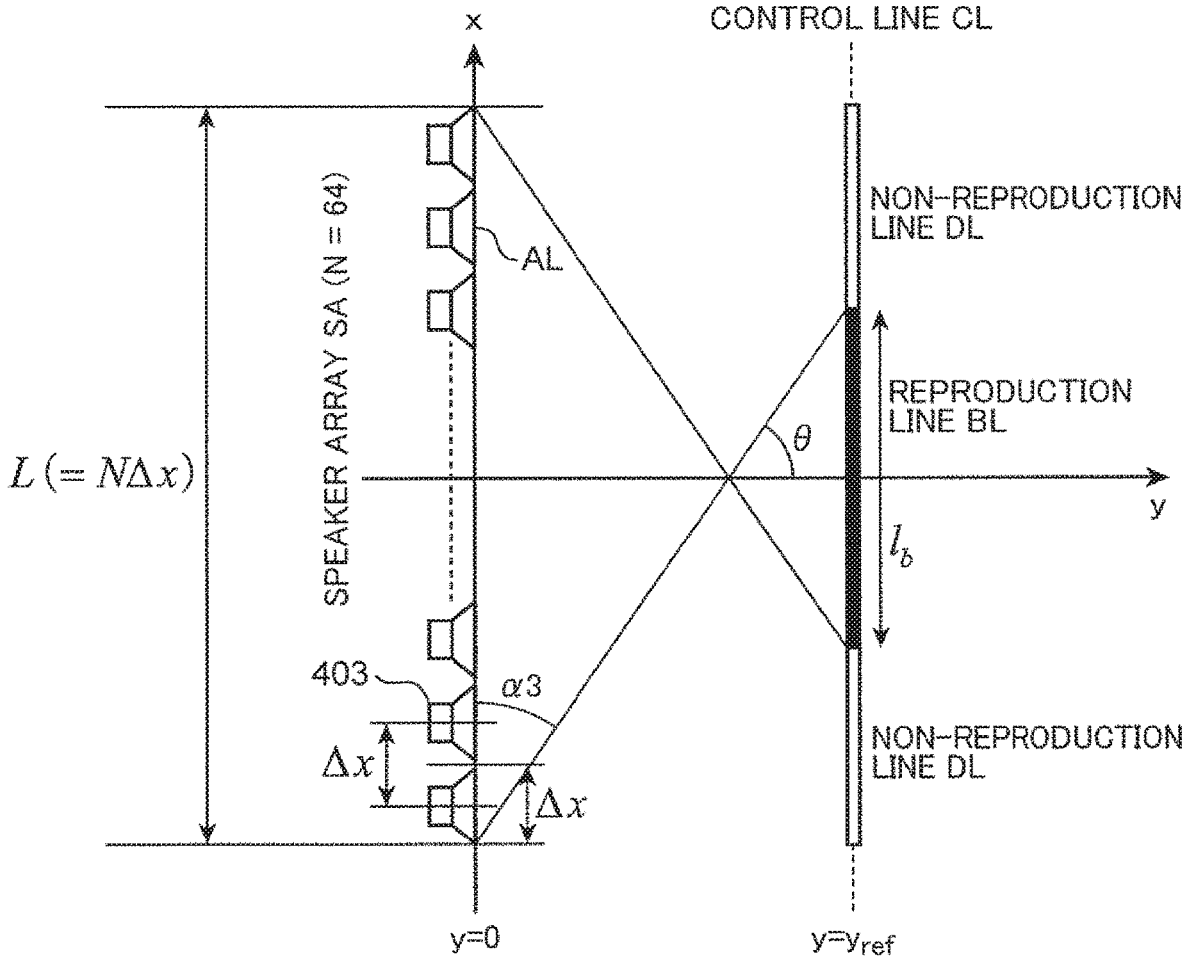
FIG. 13 is a schematic diagram for describing processing of determining a spatial frequency for use in adjustment of reproduced sound in a second modification of the present embodiment.

FIG. 13 is a schematic diagram for describing processing of determining a spatial frequency for use in adjustment of reproduced sound in the second modification of the present embodiment.

In the second modification of the present embodiment, the spatial frequency kx is represented by the above-described Formula (5), and the angle θ formed by a plane wave represented by the spatial frequency kx and the array line AL is represented by the above-described Formula (6).

In a case where the angle θ is smaller than an angle α3 formed by the straight line linking one end portion of the array line AL and the other end portion of the reproduction line BL and the array line AL, the spatial frequency processing portion 312 determines the spatial frequency kx corresponding to the angle θ as a spatial frequency for use in the adjustment of reproduced sound. Then, the spatial frequency processing portion 312 sets a value of the sound pressure Pkx(θ) of the determined spatial frequency kx to be zero.

Figure 14:
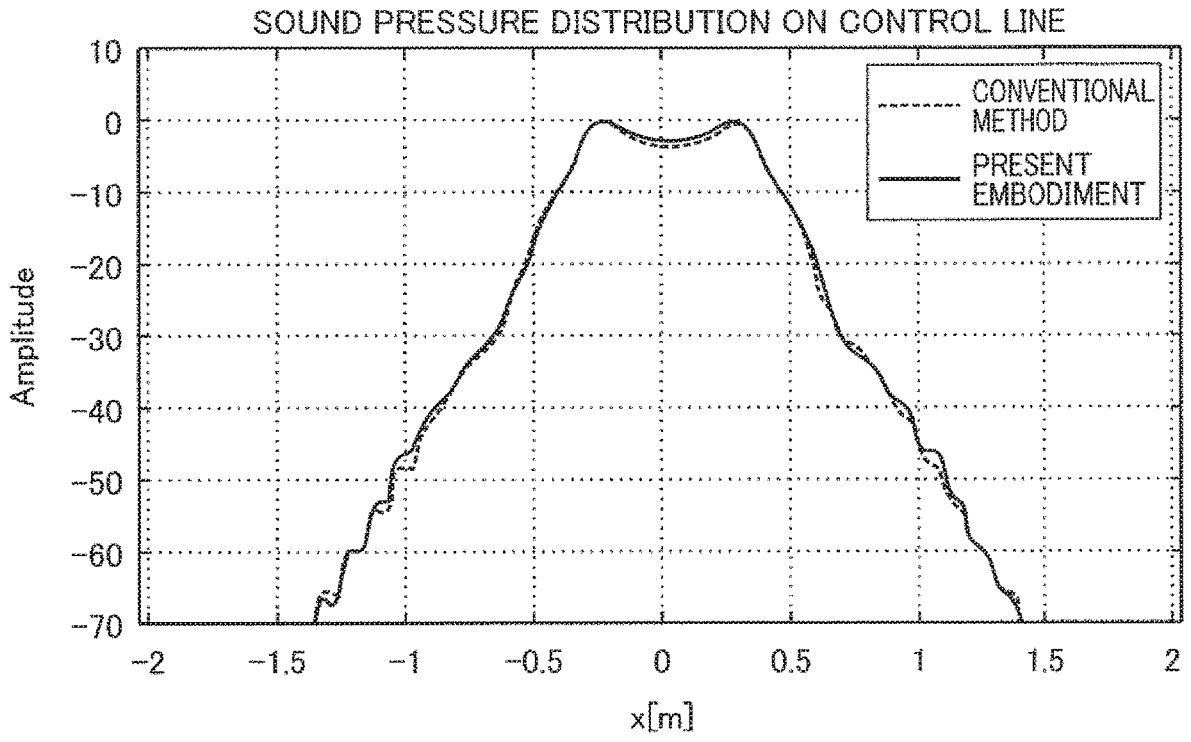
FIG. 14 is a diagram showing one example of a sound pressure distribution on a control line in a frequency domain in the second modification of the present embodiment.
Figure 15:
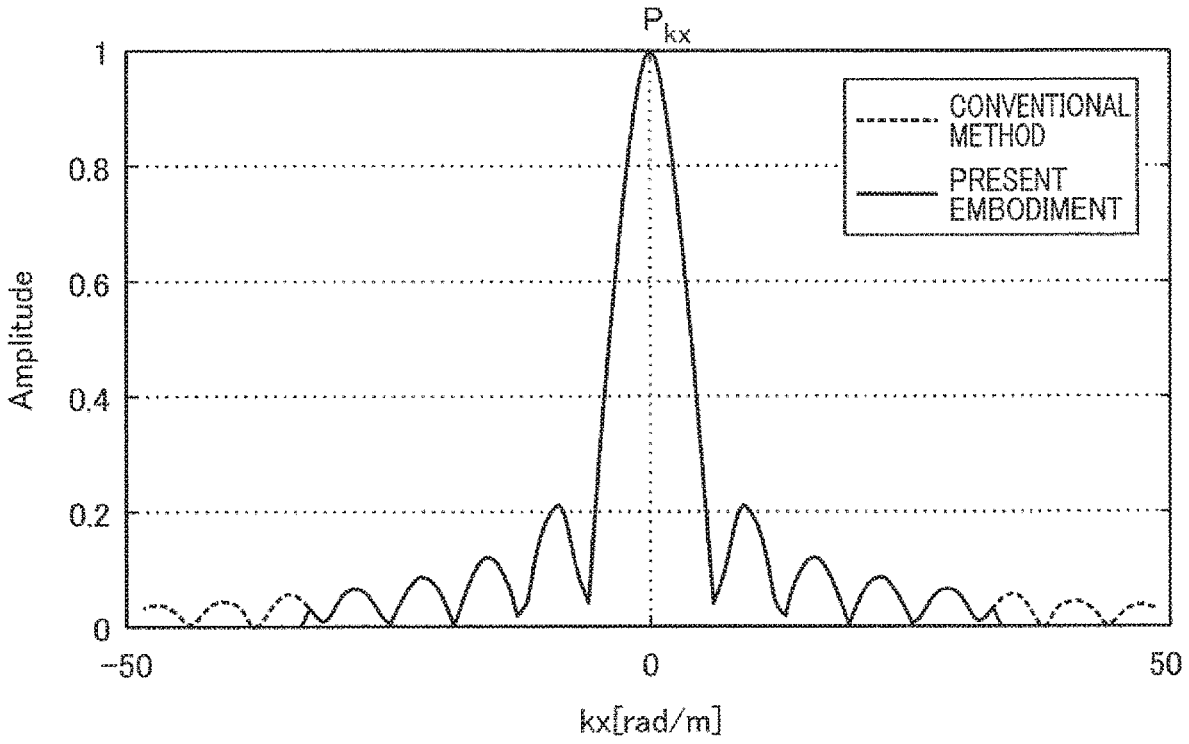
FIG. 15 is a diagram showing one example of a sound pressure distribution on a control line in a spatial frequency domain in the second modification of the present embodiment.

FIG. 14 is a diagram showing one example of a sound pressure distribution on a control line in a frequency domain in the second modification of the present embodiment, and FIG. 15 is a diagram showing one example of a sound pressure distribution on a control line in a spatial frequency domain in the second modification of the present embodiment. In each of FIG. 14 and FIG. 15, a broken line denotes an area reproduction method according to a conventional technique and a solid line denotes an area reproduction method according to the present embodiment.

As shown in FIG. 14, in the conventional technique, a sound pressure of the non-reproduction line DL on the control line CL is suppressed in a frequency domain. In a case where the sound pressure distribution shown in FIG. 14 is converted from a sound pressure distribution in a frequency domain into that in a spatial frequency domain, all the sound pressures of the non-reproduction line DL on the control line CL remain in a spatial frequency domain in the conventional technique as shown in FIG. 15. By contrast, in the second modification of the present embodiment, a sound pressure of a part of the non-reproduction line DL on the control line CL is zero in a spatial frequency domain.

Figure 16:
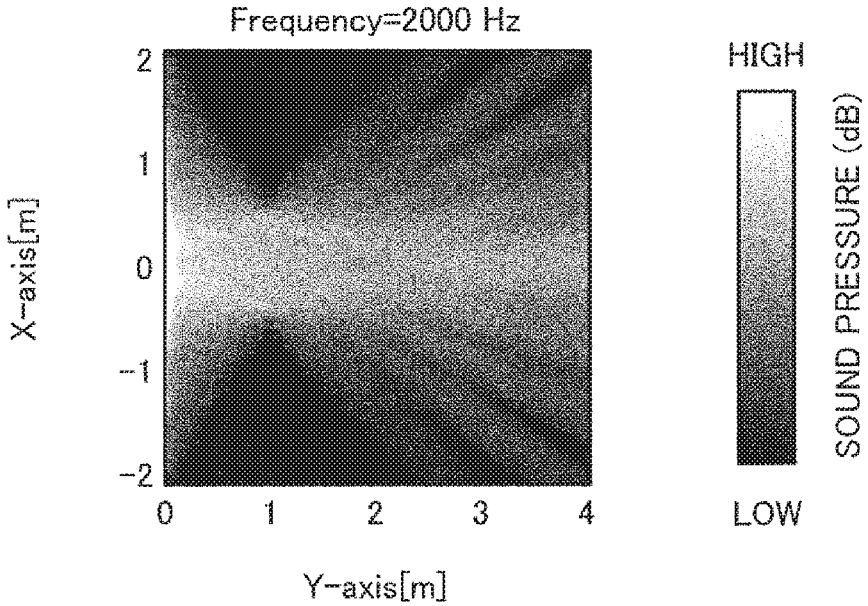
FIG. 16 is a diagram showing a sound pressure distribution in an x-y plane reproduced by an area reproduction method according to the second modification of the present embodiment.

FIG. 16 is a diagram showing a sound pressure distribution in an x-y plane reproduced by an area reproduction method according to the second modification of the present embodiment. In FIG. 16, it is assumed that 64 (N=64) of the speakers 403 with a width of 35 mm are arranged on the x axis to form the speaker array SA. It is also assumed that the arrangement interval Δx between the respective speakers 403 is 35 mm. It is further assumed that a line orthogonal to the center of the speaker array SA in the x axis direction is the y axis and the distance $y_{ref}$ from the speaker array SA to the control line CL is 1 m. It is also assumed that a width 1*b* of the reproduction line BL on the control line CL is 2 m and the center of the reproduction line BL in the x axis direction is on the y axis (x=0).

While in the conventional technique shown in FIG. 6, a reproduced sound emitted from the speaker array SA is heard only at the reproduction line BL on the control line CL to realize appropriate area reproduction, area reproduction performance backward of the control line CL is deteriorated. On the other hand, in the second modification of the present embodiment shown in FIG. 16, a reproduced sound emitted from the speaker array SA has a sound pressure in a non-reproduction area reduced not only on the control line CL but also backward of the control lure CL, so that deterioration of area reproduction performance backward of the control line CL can be improved. Additionally, since no side lobe is present in a sound pressure distribution in a spatial frequency domain, auditory easiness of hearing a reproduced sound can be improved.

Subsequently, a third modification of the present embodiment will be described. In the third modification of the present embodiment, in a case where the angle θ is smaller than an angle (the sixth angle) formed by a straight line linking one end portion of the array line AL and the other end portion of the control line CL and the array line AL, the spatial frequency processing portion 312 determines a spatial frequency kx corresponding to the angle θ as a spatial frequency for use in the adjustment of reproduced sound.

Figure 17:
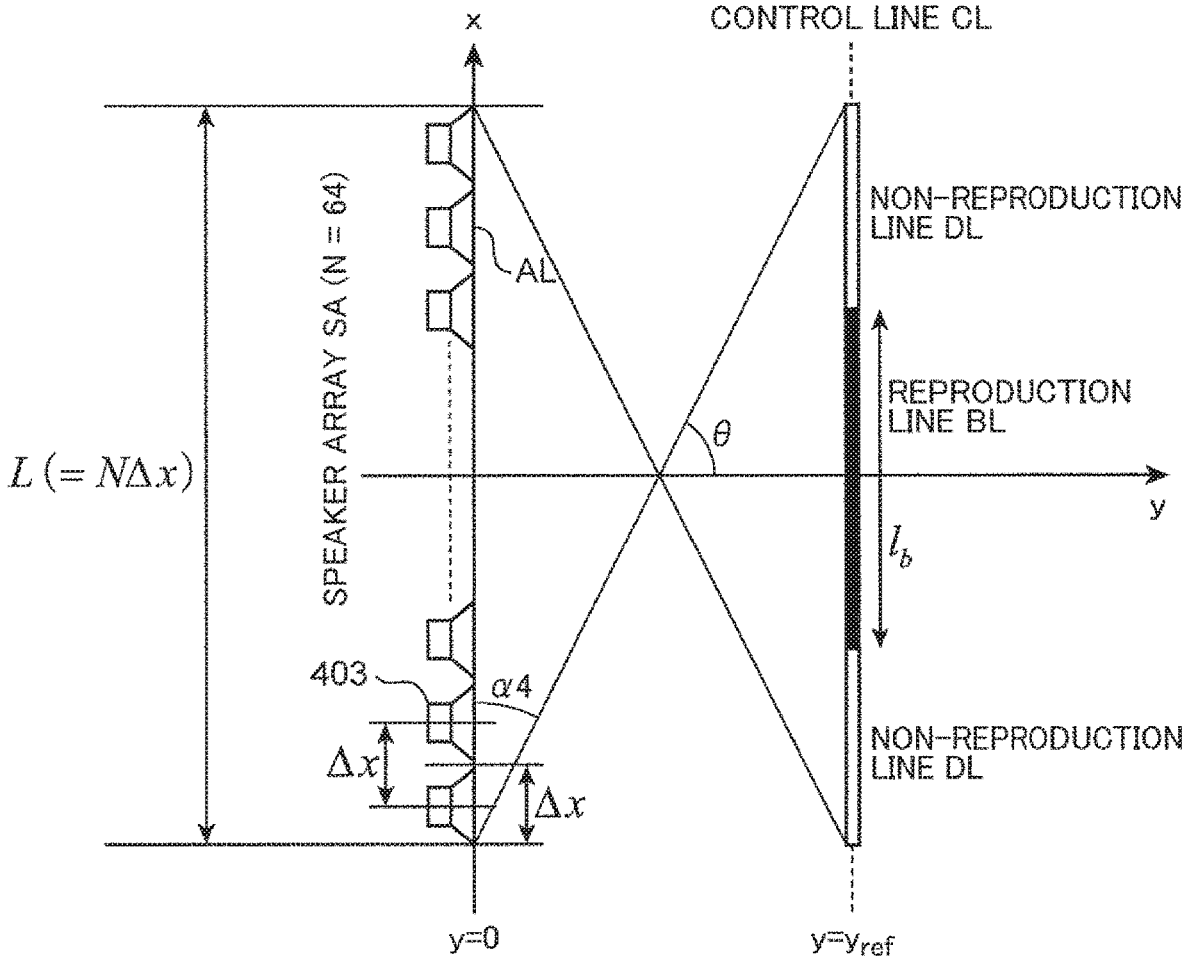
FIG. 17 is a schematic diagram for describing processing of determining a spatial frequency for use in adjustment of reproduced sound in a third modification of the present embodiment.

FIG. 17 is a schematic diagram for describing processing of determining a spatial frequency for use in adjustment of reproduced sound in the third modification of the present embodiment.

In the third modification of the present embodiment, the spatial frequency kx is represented by the above-described Formula (5), and the angle θ formed by a plane wave represented by the spatial frequency kx and the array line AL is represented by the above-described Formula (6).

In a case where the angle θ is smaller than α4 formed by the straight line linking one end portion of the array line AL and the other end portion of the control line CL and the array line AL, the spatial frequency processing portion 312 determines the spatial frequency kx corresponding to the angle θ as a spatial frequency for use in the adjustment of reproduced sound. Then, the spatial frequency processing portion 312 sets a value of the sound pressure Pkx(θ) of the determined spatial frequency kx to be zero.

Figure 18:
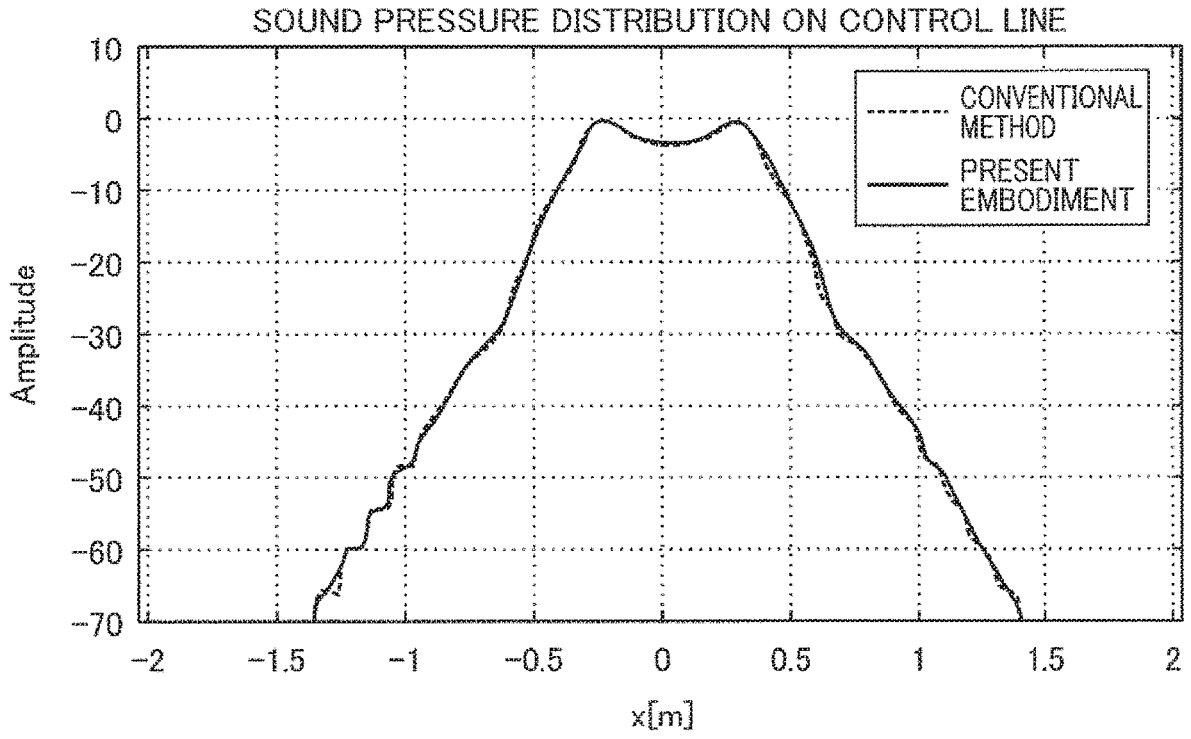
FIG. 18 is a diagram showing one example of a sound pressure distribution on a control line in a frequency domain in the third modification of the present embodiment.
Figure 19:
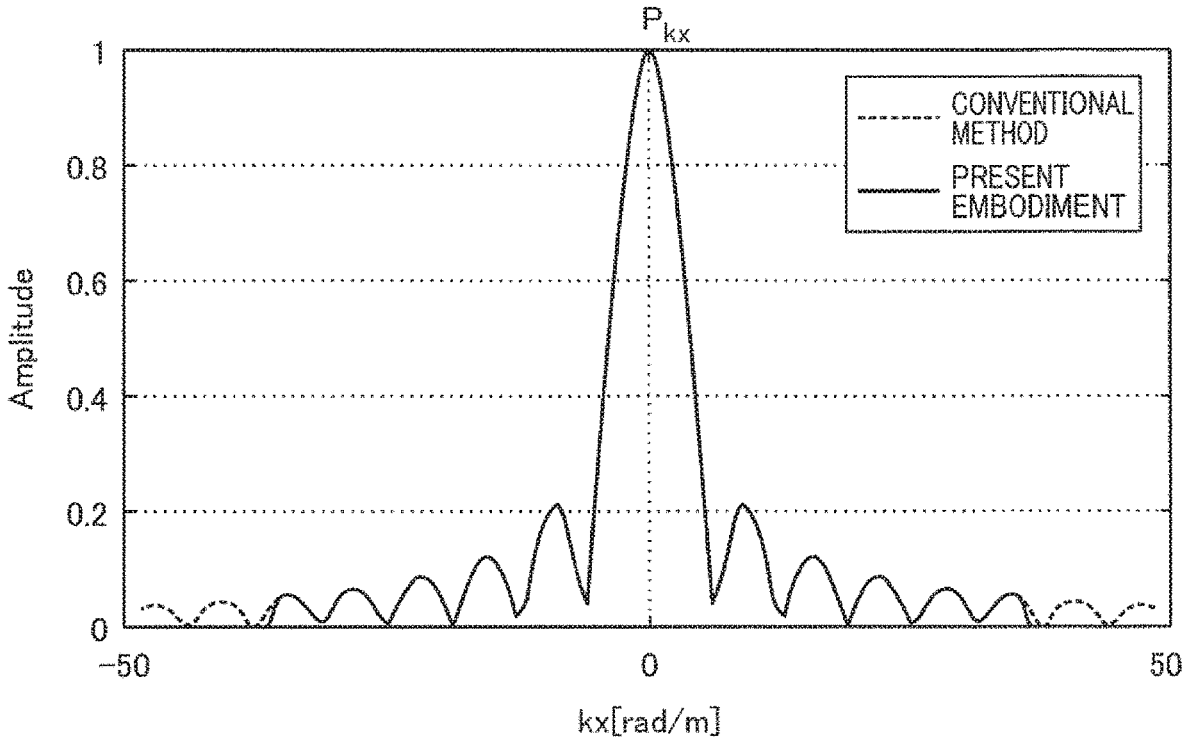
FIG. 19 is a diagram showing one example of a sound pressure distribution on a control line in a spatial frequency domain in the third modification of the present embodiment.

FIG. 18 is a diagram showing one example of a sound pressure distribution on a control line in a frequency domain in the third modification of the present embodiment, and FIG. 19 is a diagram showing one example of a sound pressure distribution on a control line in a spatial frequency domain in the third modification of the present embodiment. In each of FIG. 18 and FIG. 19, a broken line denotes an area reproduction method according to a conventional technique and a solid line denotes an area reproduction method according to the present embodiment.

As shown in FIG. 18, in the conventional technique, a sound pressure of the non-reproduction line DL on the control line CL is suppressed in a frequency domain. In a ease where the sound pressure distribution shown in FIG. 18 is converted from a sound pressure distribution in a frequency domain into that in a spatial frequency domain, all the sound pressures of the non-reproduction line DL on the control line CL remain in a spatial frequency domain in the conventional technique as shown in FIG. 19. By contrast, in the third modification of the present embodiment, a sound pressure of a part of the non-reproduction line DL on the control line CL is zero in a spatial frequency domain.

Figure 20:
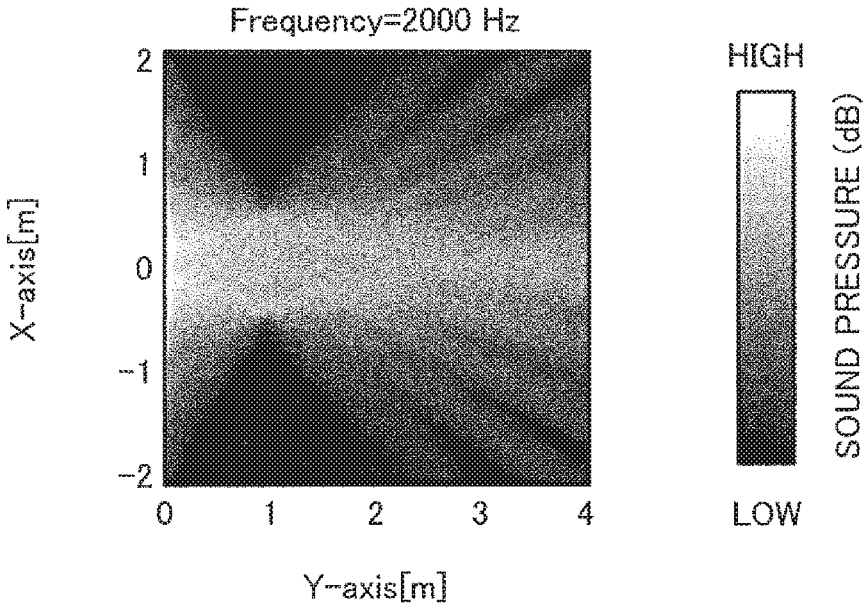
FIG. 20 is a diagram showing a sound pressure distribution in an x-y plane reproduced by an area reproduction method according to the third modification of the present embodiment.

FIG. 20 is a diagram showing a sound pressure distribution in an x-y plane reproduced by an area reproduction method according to the third modification of the present embodiment. In FIG. 20, it is assumed that 64 (N=64) of the speakers 403 with a width of 35 mm are arranged on the x axis to form the speaker array SA. It is also assumed that the arrangement interval Δx between the respective speakers 403 is 35 mm. It is further assumed that a line orthogonal to the center of the speaker array SA in the x axis direction is the y axis and the distance $y_{ref}$ from the speaker array SA to the control line CL is 1 m. It is also assumed that a width lb of the reproduction line BL on the control line CL is 2 m and the center of the reproduction line BL in the x axis direction is on the y axis (x=0).

While in the conventional technique shown in FIG. 6, a reproduced sound emitted from the speaker array SA is heard only at the reproduction line BL on the control line CL to realize appropriate area reproduction, area reproduction performance backward of the control line CL is deteriorated. On the other hand, in the third modification of the present embodiment shown in FIG. 20, a reproduced sound emitted from the speaker array SA has a sound pressure in a non-reproduction area reduced not only on the control line CL but also backward of the control line CL, so that deterioration of area reproduction performance backward of the control line CL can be improved. Additionally, since no side lobe is present in a sound pressure distribution in a spatial frequency domain, auditory easiness of hearing a reproduced sound can be improved.

Subsequently, a fourth modification of the present embodiment will be described. In the fourth modification of the present embodiment, the spatial frequency processing portion 312 multiplies a sound pressure distribution in a spatial frequency domain by a predetermined window function having a width of a predetermined threshold value of a spatial frequency. Here, the window function can be, for example, a rectangular window or a Hanning window.

Figure 21:
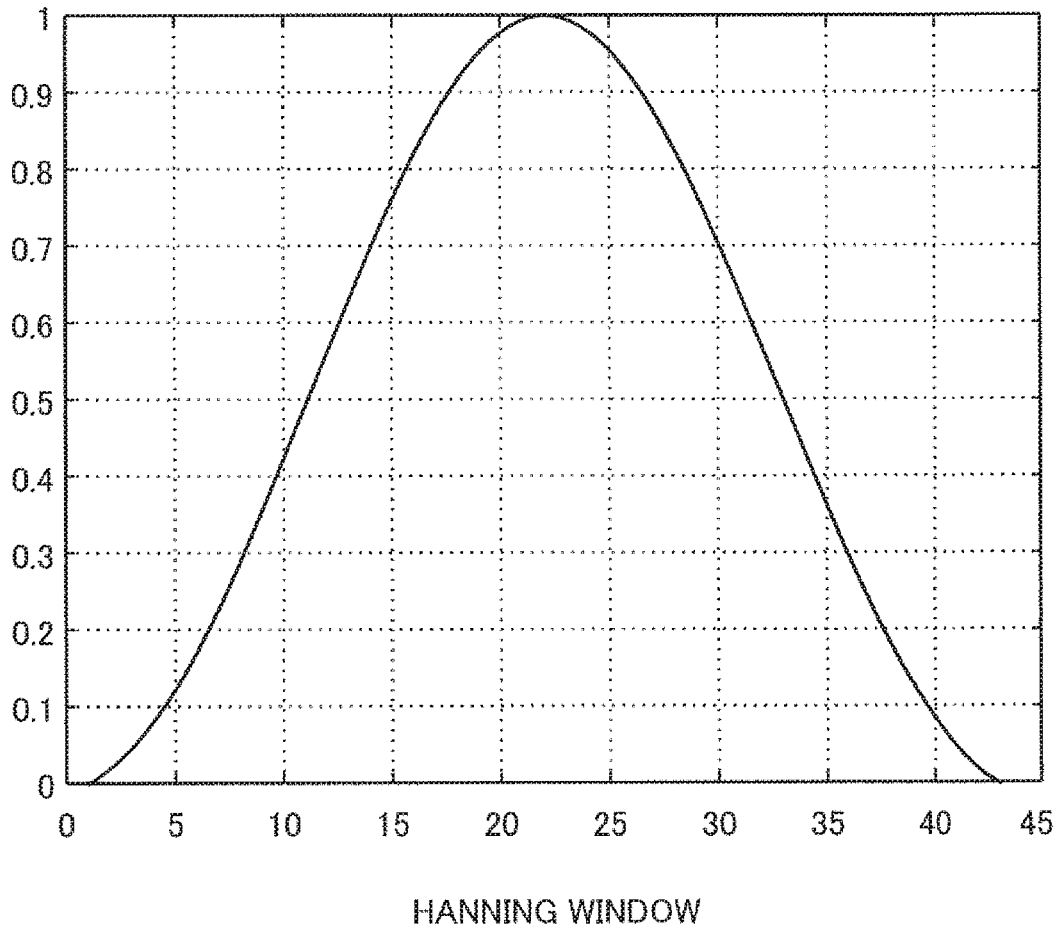
FIG. 21 is a diagram showing one example of a window function for use in adjustment of reproduced sound in a fourth modification of the present embodiment.

FIG. 21 is a diagram showing one example of a window function for use in adjustment of reproduced sound in the fourth modification of the present embodiment. The window function shown in FIG. 21 is a Hanning window.

In the fourth modification of the present embodiment, the spatial frequency kx is represented by the above-described Formula (5).

The spatial frequency processing portion 312 multiplies a sound pressure distribution in a spatial frequency domain by a Hanning window having a width of a predetermined threshold value of a spatial frequency.

Figure 22:
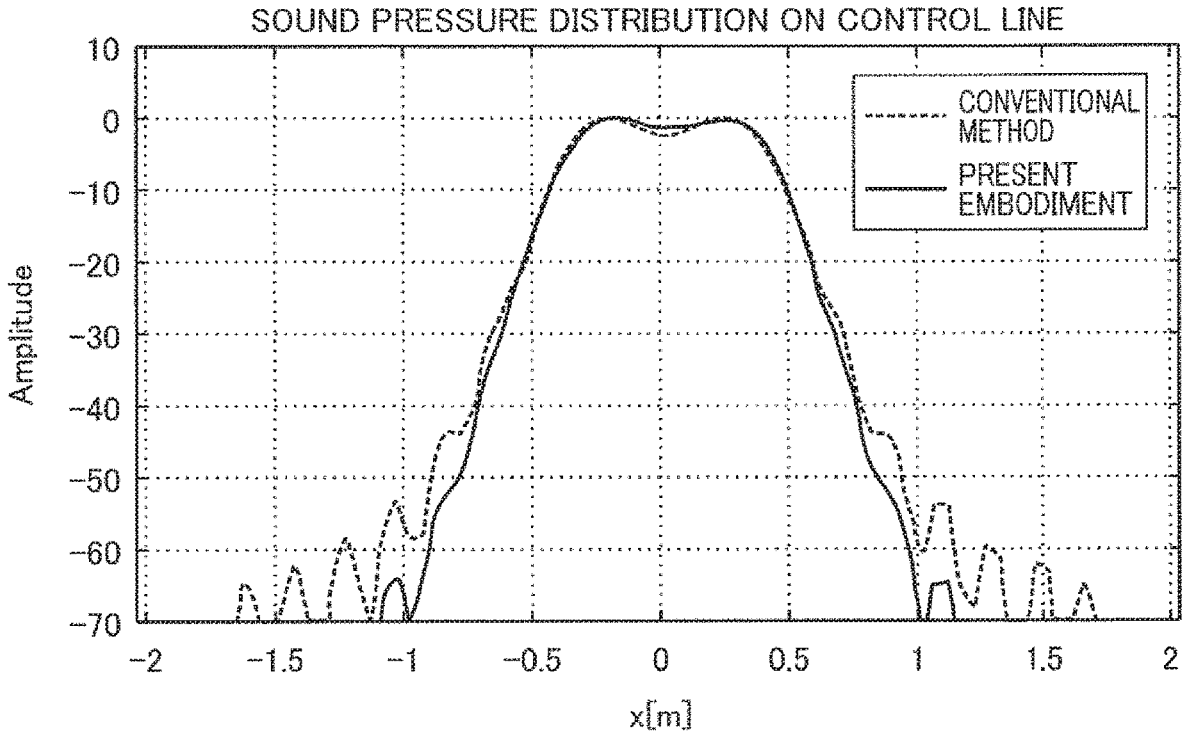
FIG. 22 is a diagram showing one example of a sound pressure distribution on a control line in a frequency domain in the fourth modification of the present embodiment.
Figure 23:
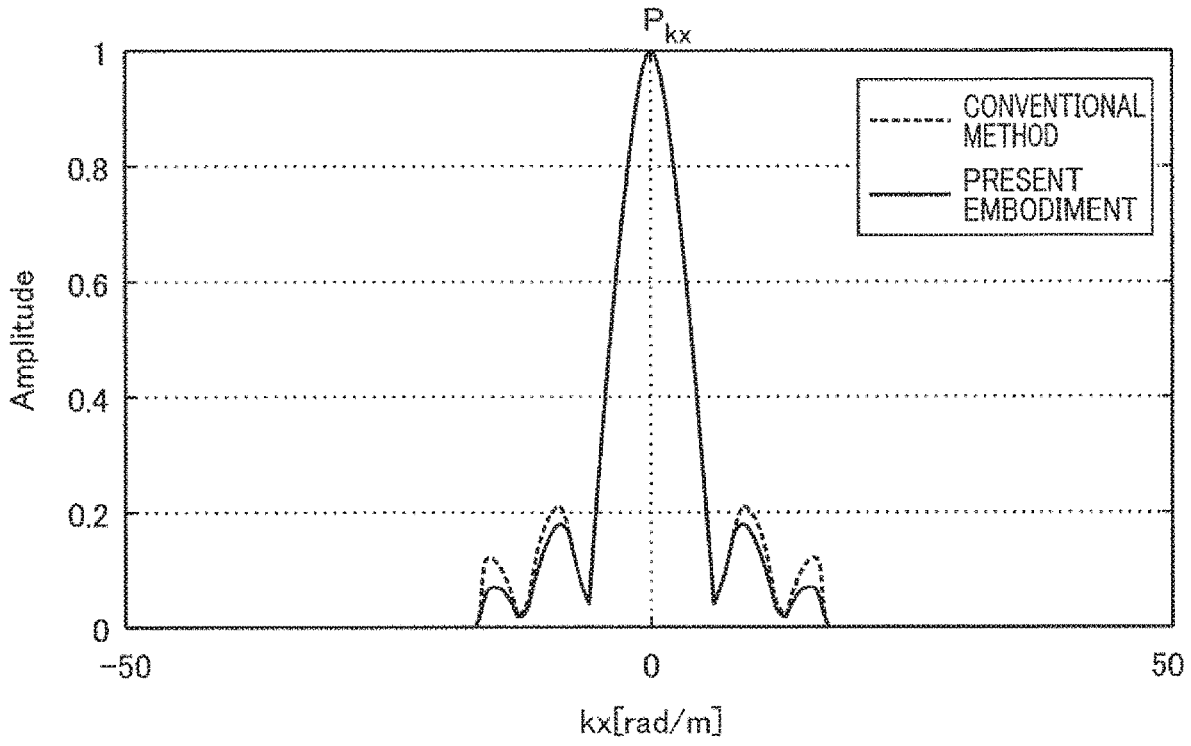
FIG. 23 is a diagram showing one example of a sound pressure distribution on a control line in a spatial frequency domain in the fourth modification of the present embodiment.

FIG. 22 is a diagram showing one example of a sound pressure distribution on a control line in a frequency domain in the fourth modification of the present embodiment, and FIG. 23 is a diagram showing one example of a sound pressure distribution on a control line in a spatial frequency domain in the fourth modification of the present embodiment. In each of FIG. 22 and FIG. 23, a broken line denotes an area reproduction method according to a conventional technique and a solid line denotes an area reproduction method according to the present embodiment.

As shown in FIG. 22, in the conventional technique, a sound pressure of the non-reproduction line DL on the control line CL is suppressed in a frequency domain. In a case where the sound pressure distribution shown in FIG. 22 is converted from a sound pressure distribution in a frequency domain into that in a spatial frequency domain, all the sound pressures of the non-reproduction line DL on the control line CL remain in a spatial frequency domain in the conventional technique as shown in FIG. 23. By contrast, in the fourth modification of the present embodiment, a sound pressure of the non-reproduction line DL cert the control line CL is zero in a spatial frequency domain.

Figure 24:
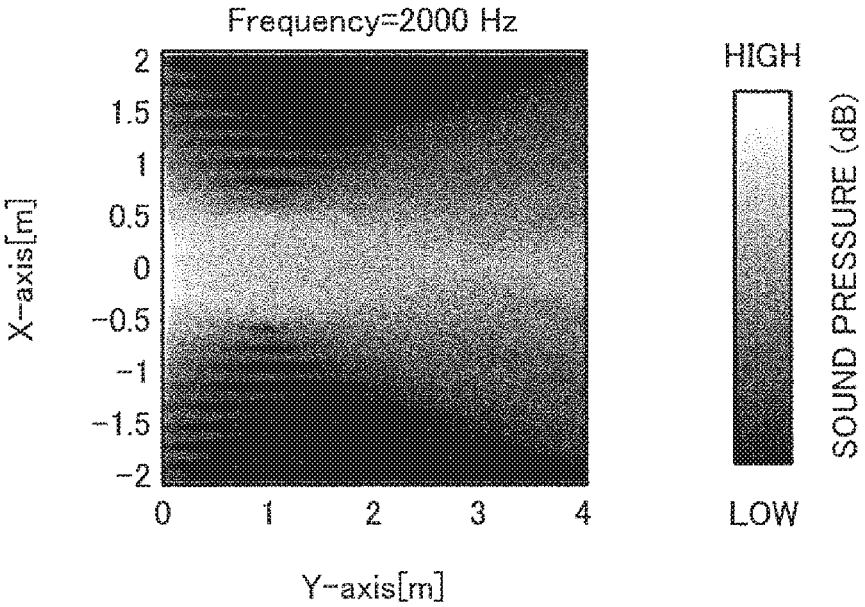
PRIOR ART FIG. 24
FIG. 24 is a diagram showing a sound pressure distribution in an x-y plane reproduced by the area reproduction method according to a conventional technique.
Figure 25:
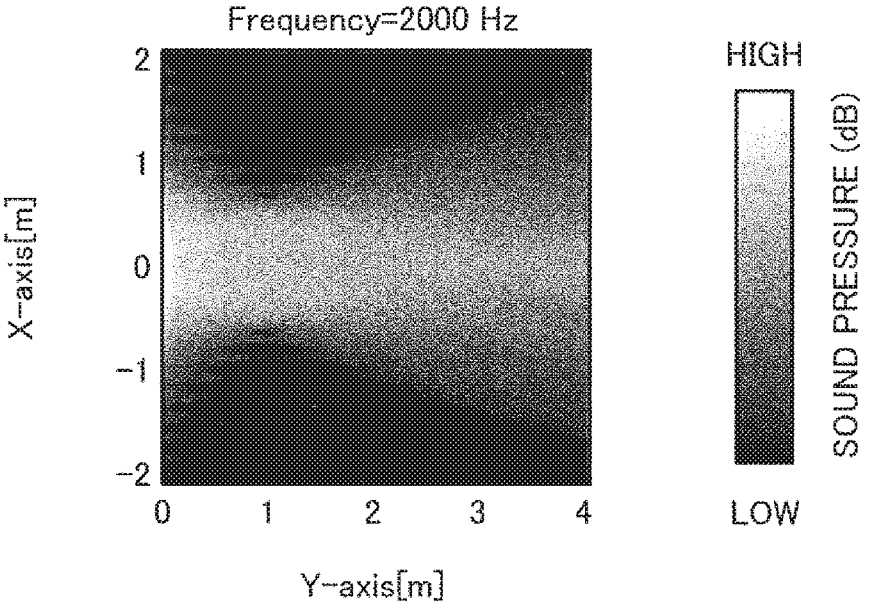
FIG. 25 is a diagram showing a sound pressure distribution in an x-y plane reproduced by an area reproduction method according to the fourth modification of the present embodiment.

FIG. 24 is a diagram showing a sound pressure distribution in an x-y plane reproduced by the area reproduction method according to a conventional technique, and FIG. 25 is a diagram showing a sound pressure distribution in an x-y plane reproduced by an area reproduction method according to the fourth modification of the present embodiment. In FIG. 24 and FIG. 25, it is assumed that 64 (N=64) of the speakers 403 with a width of 35 mm are arranged on the x axis to form the speaker array SA. It is also assumed that the arrangement interval Δx between the respective speakers 403 is 35 mm. It is further assumed that a line orthogonal to the center of the speaker array SA in the x axis direction is the y axis and the distance $y_{ref}$ from the speaker array SA to the control line CL is 1 m. It is also assumed that a width lb of the reproduction line BL on the control line CL is 2 m and the center of the reproduction line BL in the x axis direction is on the y axis (x=0). Additionally, the spatial frequency processing portion 312 multiplies the sound pressure distribution in the spatial frequency domain by the Hanning window shown in FIG. 21.

While in the conventional technique shown in FIG. 24, a reproduced sound emitted from the speaker array SA is heard only at the reproduction line BL on the control line CL to realize appropriate area reproduction, area reproduction performance backward of the control line CL is deteriorated. On the other hand, in the fourth modification of the present embodiment shown in FIG. 25, a reproduced sound emitted from the speaker array SA has a sound pressure in a non-reproduction area reduced not only on the control line CL but also backward of the control line CL, so that deterioration of area reproduction performance backward of the control line CL can be improved. Additionally, since no side lobe is present in a sound pressure distribution in a spatial frequency domain, auditory easiness of hearing a reproduced sound can be improved.

While in the present embodiment, the control line includes one reproduction line BL, the present disclosure is not particularly limited thereto, and the control line CL may include the plurality of reproduction lines BL. In other words, in a case where a plurality of persons are present within a space in which the speaker array SA is present, the area reproduction system is allowed to output different reproduced sounds to the plurality of persons.

Figure 26:
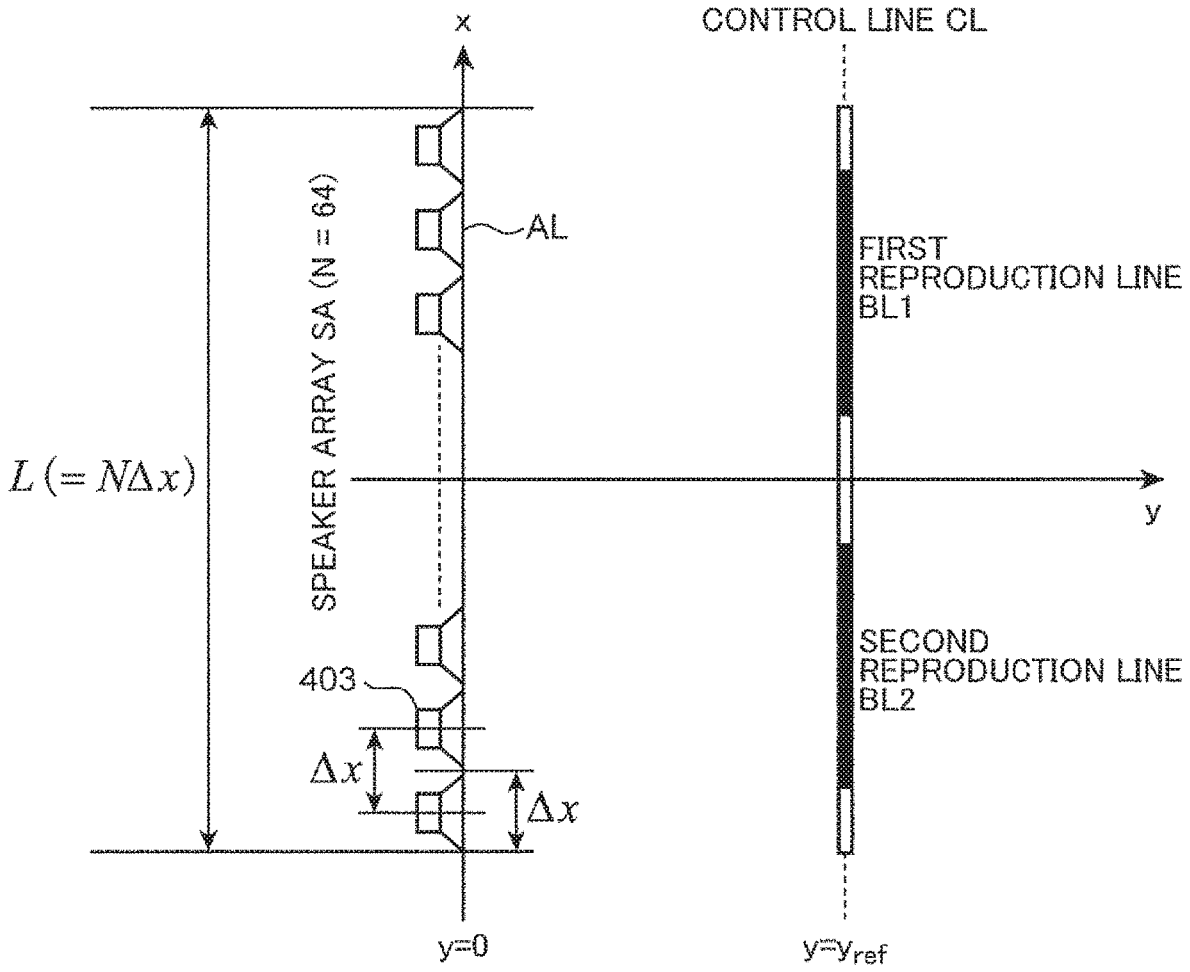
FIG. 26 is a schematic diagram for describing a control line including a plurality of reproduction lines in a fifth modification of the present embodiment.

FIG. 26 is a schematic diagram for describing a control line including a plurality of reproduction lines in a fifth modification of the present embodiment. The control line CL shown in FIG. 26 includes a first reproduction line BL1 and a second reproduction line BL2.

The touch panel 101 accepts user's input of reproduction conditions. At this time, the reproduction conditions include, for example, an arrangement interval Δx between the respective speakers 403, the number N of the speakers 403 provided in the speaker array SA, the distance $y_{ref}$ from the speaker array SA to the control line CL in the y axis direction, a width lb1 of the first reproduction line BL1, a sound volume of a reproduced sound on the first reproduction line BL1, a width lb2 of the second reproduction line BL2, and a sound volume of a reproduced sound on the second reproduction line BL2. The processing unit 30 obtains first sound source data to be reproduced on the first reproduction line BL1 and second sound source data to be reproduced on the second reproduction line BL2 from the data unit 20.

For reproducing a number M of sound sources $s_i(\omega)$ in separate reproduction lines at M places, the drive signal $D(x_0, \omega)$ is calculated by superimposition of a combination $s_i(\omega)F_i(x_0, \omega)$ of a control filter $F_i$ at each reproduction line position and the corresponding sound source $s_i$. Specifically, the filter generation portion 301 generates a drive signal $D_i$ for driving each speaker 403 by the sound source $s_i$ and the control filter $F_i$ of each speaker 403 and drives each speaker. The reproduction unit 40 outputs different reproduced sounds for the plurality of reproduction lines.

While the embodiments of the present disclosure have been described in the foregoing, an entity or a device subjected to each processing is not limited to those described in the above-embodiments. Each processing can be conducted by a processor or the like incorporated into a specific device (hereinafter, referred to as a local device) provided in the area reproduction system 1. Alternatively, each processing may be conducted by a cloud server or the like provided at a place different from a local device. The local device and the cloud server may have information in conjunction with each other to share each processing as is described in the present disclosure. Modes of the present disclosure will be described in the following.

(1) Each of the above-described devices is specifically a computer system configured with a microprocessor, a ROM, a RAM, a hard disk unit, a display unit, a keyboard, a mouse, and the like. A computer program is stored in the RAM or the hard disk unit. As a result of operation of the microprocessor according to the computer program, each device realizes function thereof. The computer program herein is formed by combining a plurality of instruction codes indicative of an instruction to the computer in order to realize predetermined function.

(2) A part or all of the above-described components forming each of the above-described devices may be configured with one system large scale integration (LSI). The system LSI is a super-multifunctional LSI manufactured with a plurality of components integrated on one chip. Specifically, the system LSI is a computer system configured to include a microprocessor, a ROM, a RAM, and the like. A computer program is stored in the RAM. As a result of operation of the microprocessor according to the computer program, the system LSI realizes function thereof.

(3) A part or all of the components forming ach of the above-described devices may be configured with an IC card or a single module detachable from each device. The IC card or the module is a computer system configured with a microprocessor, a ROM, a RAM, and the like. The IC card or the module may include the above-described super-multifunctional LSI. As a result of operation of the microprocessor according to the computer program, the IC card or the module realizes function thereof.

(4) The present disclosure may relate to a processing method in the above-described area reproduction system 1. The present disclosure may also relate to a computer program which realizes the processing method by a computer, or to a digital signal formed with a computer program.

(5) Additionally, the present disclosure may relate to a computer program or a digital signal funned with a computer program and recorded in a computer readable recording medium such as a flexible disk, a hard disk, a CD-ROM, an MO, a DVD, a DVD-ROM, a DVD-RAM, a Blu-ray (registered trademark) Disc (BD) or a semiconductor memory. Alternatively, the present disclosure may relate to a digital signal recorded in these recording media.

The present disclosure may also relate to a computer program or a digital signal formed with a computer program which is transmitted via a telecommunication line, a radio or cable communication line, network exemplified by the Internet, data broadcasting or the like.

The present disclosure may also relate to a computer system including a microprocessor and a memory, the memory storing the above-described computer program and the microprocessor being operable according to the computer program.

Additionally, the processing may be executed by other independent computer system by recording a program or a digital signal in a recording medium and transferring the same, or transferring a program or a digital signal via a network or the like.

(6) The above-described embodiments and modifications thereof can be combined.

The area reproduction method, the computer readable recording medium which records an area reproduction program, and the area reproduction system according to the present disclosure enable improvement of deterioration of area reproduction performance backward of a control line provided near a speaker array and are useful as an area reproduction method of outputting reproduced sound from a speaker array including a plurality of speakers arranged to a predetermined area, a computer readable recording medium which records an area reproduction program, and an area reproduction system.

This application is based on Japanese Patent application No. 2017-254514 filed in Japan Patent Office on Dec. 28, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An area reproduction method of outputting reproduced sound from a speaker array including a plurality of speakers arranged to a predetermined area, the area reproduction method comprising:

converting a sound pressure distribution at each frequency of the reproduced sound from a sound pressure distribution in a frequency domain into a sound pressure distribution in a spatial frequency domain, the reproduced sound being realized on a control line including a reproduction line in which sound waves emitted from the speaker array intensify with each other and a non-reproduction line in which the sound waves weaken with each other;

determining a spatial frequency for use in adjustment of the reproduced sound, in the sound pressure distribution in the spatial frequency domain, based on a positional relationship between the speaker array and the control line; and adjusting a sound pressure of the reproduced sound which is to be output by each of the plurality of speakers using the determined spatial frequency, wherein in the determination of the spatial frequency, a spatial frequency for use in the adjustment of the reproduced sound is determined based on a first angle formed by a plane wave represented by the spatial frequency and by an array line along the speaker array, and a second angle represented by a straight line linking one point on the array line and one point on the control line and by the array line.

2. The area reproduction method according to claim 1, wherein the spatial frequency kx is represented by Formula (1) below $$kx=2\pi n/(N\Delta x) \quad (1),$$

wherein N represents a number of the plurality of speakers, n represents an integer and a relation of $-N/2 \leq n \leq N/2-1$ is satisfied, $\Delta x$ represents an interval between speakers adjacent to each other among the plurality of speakers, and the first angle $\theta$ is represented by Formula (2) below $$\theta=180/\pi a \sin(kx/(\omega/c)) \quad (2),$$

wherein $\omega$ represents an angular frequency and c represents sound velocity.

3. The area reproduction method according to claim 2, wherein the second angle includes a third angle formed by a straight line linking a center of the array line and one end portion of the reproduction line and the array line, in determination of the spatial frequency, in a case where the first angle $\theta$ is smaller than the third angle, the spatial frequency kx corresponding to the first angle $\theta$ is determined as a spatial frequency for use in adjustment of the reproduced sound, and in adjustment of the sound pressure of the reproduced sound, a value of a sound pressure $Pkx(\theta)$ of the determined spatial frequency kx is set to be zero.

4. The area reproduction method according to claim 2, wherein the second angle includes a fourth angle formed by a straight line linking the center of the array line and one end portion of the control line and the array line, in determination of the spatial frequency, in a case where the first angle $\theta$ is smaller than the fourth angle, the spatial frequency kx corresponding to the first angle $\theta$ is determined as a spatial frequency for use in adjustment of the reproduced sound, and in adjustment of the sound pressure of the reproduced sound, a value of a sound pressure $Pkx(\theta)$ of the determined spatial frequency kx is set to be zero.

5. The area reproduction method according to claim 2, wherein the second angle includes a fifth angle formed by a straight line linking one end portion of the array line and the other end portion of the reproduction line and the array line, in determination of the spatial frequency, in a case where the first angle $\theta$ is smaller than the fifth angle, the spatial frequency kx corresponding to the first angle $\theta$ is determined as a spatial frequency for use in adjustment of the reproduced sound, and in adjustment of the sound pressure of the reproduced sound, a value of a sound pressure $Pkx(\theta)$ of the determined spatial frequency kx is set to be zero.

6. The area reproduction method according to claim 2, wherein the second angle includes a sixth angle formed by a straight line linking one end portion of the array line and the other end portion of the control line and the array line, in determination of the spatial frequency, in a case where the first angle $\theta$ is smaller than the sixth angle, the spatial frequency kx corresponding to the first angle $\theta$ is determined as a spatial frequency for use in adjustment of the reproduced sound, and in adjustment of the sound pressure of the reproduced sound, a value of a sound pressure Pkx(θ) of the determined spatial frequency kx is set to be zero.

7. The area reproduction method according to claim 1, wherein in adjustment of the sound pressure of the reproduced sound, the sound pressure distribution in the spatial frequency domain is multiplied by a predetermined window function.

8. The area reproduction method according to claim 7, wherein the window function is a rectangular window.

9. The area reproduction method according to claim 1, wherein the control line includes a plurality of reproduction lines, to each of which reproduction lines, a different reproduced sound is output.

10. The area reproduction method according to claim 1, wherein the spatial frequency domain has no non-physical area.

11. A computer readable recording medium that records an area reproduction program for outputting reproduced sound from a speaker array, including a plurality of speakers arranged to a predetermined area, the area reproduction program causing a computer to execute processing of:

converting a sound pressure distribution at each frequency of the reproduced sound from a sound pressure distribution in a frequency domain into a sound pressure distribution in a spatial frequency domain, the reproduced sound being realized on a control line including a reproduction line in which sound waves emitted from the speaker array intensify with each other and a non-reproduction line in which the sound waves weaken with each other;

determining a spatial frequency for use in adjustment of the reproduced sound, in the sound pressure distribution in the spatial frequency domain, based on a positional relationship between the speaker array and the control line; and adjusting a sound pressure of the reproduced sound which is to be output by each of the plurality of speakers using the determined spatial frequency, wherein in the determination of the spatial frequency, a spatial frequency for use in the adjustment of the reproduced sound is determined based on a first angle formed by a plane wave represented by the spatial frequency and by an array line along the speaker array, and a second angle represented by a straight line linking one point on the array line and one point on the control line and by the array line.

12. An area reproduction system, comprising:

a reproduction device including a speaker array that includes a plurality of speakers arranged; and a processor that adjusts a sound pressure of a reproduced sound to be output by each of the plurality of speakers based on a control line, including a reproduction line in which sound waves emitted from the speaker array intensify with each other, and a non-reproduction line in which the sound waves weaken with each other, and causes the reproduction unit to output the reproduced sound, wherein the processor converts a sound pressure distribution at each frequency of the reproduced sound to be realized on the control line from a sound pressure distribution in a frequency domain into a sound pressure distribution in a spatial frequency domain, determines a spatial frequency for use in adjustment of the reproduced sound, in the sound pressure distribution in the spatial frequency domain, based on a positional relationship between the speaker array and the control line, adjusts a sound pressure of the reproduced sound which is to be output by each of the plurality of speakers using the determined spatial frequency, and in the determination of the spatial frequency, a spatial frequency for use in the adjustment of the reproduced sound is determined based on a first angle formed by a plane wave represented by the spatial frequency and by an array line along the speaker array, and a second angle represented by a straight line linking one point on the array line and one point on the control line and by the array line.

* * * * *